US006948795B2

(12) United States Patent
Tashiro et al.

(10) Patent No.: US 6,948,795 B2
(45) Date of Patent: Sep. 27, 2005

(54) EJECTION DEVICE, MANUFACTURING DEVICE OF COLOR FILTER SUBSTRATE, MANUFACTURING DEVICE OF ELECTRO-LUMINESCENT DISPLAY DEVICE, MANUFACTURING DEVICE OF PLASMA DISPLAY DEVICE, AND EJECTION METHOD

(75) Inventors: Masayuki Tashiro, Chino (JP); Yoshiaki Yamada, Shimervu-machi (JP)

(73) Assignee: Seiko Epson Corporation, (JP)

( * ) Notice: Subject to any disclaimer, the term of this patent is extended or adjusted under 35 U.S.C. 154(b) by 0 days.

(21) Appl. No.: 10/949,746

(22) Filed: Sep. 24, 2004

(65) Prior Publication Data

US 2005/0110830 A1 May 26, 2005

(30) Foreign Application Priority Data

Sep. 26, 2003 (JP) ..... 2003-335546

(51) Int. Cl.[7] ..... B41J 2/145

(52) U.S. Cl. ..... 347/40; 347/12

(58) Field of Search ..... 347/12, 40, 15, 347/43, 69, 70; 349/104, 108

(56) References Cited

U.S. PATENT DOCUMENTS 6,254,218 B1 * 7/2001 Suzuki et al. ..... 347/43
6,808,249 B1 * 10/2004 Kneezel et al. ..... 347/43

FOREIGN PATENT DOCUMENTS

JP 2003-127343 5/2003

* cited by examiner

*Primary Examiner*—Lamson Nguyen
(74) *Attorney, Agent, or Firm*—Harness, Dickey & Pierce, P.L.C.

(57) ABSTRACT

With respect to an X coordinate shifted by a second length from an X coordinate of a reference nozzle of a first head, an X coordinate of a reference nozzle of a second head is further shifted by a length ½ times shorter than a first length. Further, with respect to an X coordinate shifted by the second length from an X coordinate of a reference nozzle of a third head, an X coordinate of a reference nozzle of a fourth head is further shifted by a length ½ times shorter than the first length. In addition, with respect to an X coordinate shifted by the second length from the X coordinate of the reference nozzle of the second head, the X coordinate of the reference nozzle of the third head is shifted by a length ¼ times or ¾ times shorter than the first length. The first length is a nozzle pitch of the head in an X-axis direction. The second length is a product of the first length and ¼ times of the number of the nozzles of the head.

13 Claims, 24 Drawing Sheets

EJECTION DEVICE, MANUFACTURING DEVICE OF COLOR FILTER SUBSTRATE, MANUFACTURING DEVICE OF ELECTRO-LUMINESCENT DISPLAY DEVICE, MANUFACTURING DEVICE OF PLASMA DISPLAY DEVICE, AND EJECTION METHOD

RELATED APPLICATIONS

This application claims priority to Japanese Patent Application No. 2003-335546 filed Sep. 26, 2003 which is hereby expressly incorporated by reference herein in its entirety.

BACKGROUND

1. Technical Field

The present invention relates to an ejection device and an ejection method for ejecting a liquid material. More specifically, the present invention relates to an ejection device and an ejection method which are suitable to be implemented in a process of coating a liquid material onto regions periodically arranged in a color filter substrate or in a matrix type display device.

2. Background Art

A technique in which a material is coated on pixel regions using an ink jet device is known. In such a technique, filter elements are typically formed on a color filter substrate or on light-emitting portions arranged in a matrix shape in a matrix type display device by using the ink jet device (for example, see Japanese Unexamined Patent Application Publication No. 2003-127343).

However, it is common that pitches corresponding to a plurality of portions to be ejected and to be coated with a liquid material are not aligned with the nozzle pitch of an ink jet device. Here, the portion to be ejected means a portion on which a filter element is to be provided.

For this reason, in a conventional ink jet device, ink jet heads (or a direction at which the ejection nozzles are arranged) are inclined with respect to the direction at which the portions to be ejected are arranged such that the distance between two portions to be ejected and the distance between two ejection nozzles are aligned. However, in such a construction, when the distance between two portions to be ejected is different for every color filter, the installation angle of the ink jet head for every color filter needs to be adjusted. To change the installation angle of the head, a new carriage to be fitted with the head must be constructed according to the new angle of the head.

In addition, if a large amount of material is required to coat one portion to be ejected, it is necessary to repeat the ejection process a number of times. As a result, the ejected amount varies between the nozzles to unevenly coat the one portion to be ejected.

The present invention is made in consideration of the above problems, and it is an object of the present invention to reduce the unevenness on the coated surfaces of portions to be ejected.

SUMMARY

An ejection device of the present invention comprises a stage and head groups which relatively move with respect to the stage. Further, each head group comprises a first head, a second head, a third head and a fourth head. Each of the first head, the second head, the third head, and the fourth head has P ejection nozzles, and the P ejection nozzles are arranged such that a nozzle pitch of each of the first head in an X-axis direction, the second head, the third head, and the fourth head becomes a first length. The first head and the second head are adjacent to each other in a Y-axis direction, and the third head and the fourth head are adjacent to each other in the Y-axis direction. Further, with respect to an X coordinate shifted by a second length from an X coordinate of a reference nozzle of the first head, an X coordinate of a reference nozzle of the second head is further shifted by a length ½ times shorter than the first length. With respect to an X coordinate shifted by the second length from an X coordinate of a reference nozzle of the third head, an X coordinate of a reference nozzle of the fourth head is further shifted by a length ½ times shorter than the first length. And then, with respect to an X coordinate shifted by the second length from the X coordinate of the reference nozzle of the second head, the X coordinate of the reference nozzle of the third head is shifted by a length ¼ times or ¾ times shorter than the first length. Moreover, the second length is P/4 times shorter than the first length, P is a natural number equal to or greater than 2, and the X-axis direction is orthogonal to the Y-axis direction.

According to the above features, even though the ejected amount of liquid droplets from the nozzles in the heads for every nozzle position is different, the difference in the ejected amount does not appear in a stream of liquid droplets ejected from the head group. This is because the difference in the ejected amount is offset since the nozzles belonging to various regions of the heads are adjacent in the X-axis direction in the head group.

In each of the four heads, the P nozzles may be arranged in the X-axis direction.

According to the above feature, it is possible to simultaneously eject the liquid droplets onto hit positions arranged in the X-axis direction.

According to the above feature, a plurality of nozzles is arranged in the X-axis direction. For this reason, it is possible to almost simultaneously eject the liquid material from the plurality of nozzles onto a target (the portion to be ejected) extending in the X-axis direction. As a result, a drive signal for ejecting the liquid material is commonly applied to the plurality of nozzles. Further, since ejection timings from the plurality of nozzles arranged in one direction are almost the same, no circuit construction for delaying the drive signal is required to be constructed. As a result, there are few factors causing the roundness of the waveform in the drive signal, and thus it is possible to drive the heads using precise drive waveforms.

In each of the four heads, the P nozzles are comprised of a first string and a second string extending in the X-axis direction. Further, in each of the first string and the second string, the plurality of nozzles is arranged at a pitch two times longer than the first length, and the first string is shifted by the first length in the X-axis direction with respect to the second string.

According to the above features, it is possible to reduce the nozzle pitch of the head in the X-axis direction. For this reason, it is possible to increase the line density of the nozzles of the head in the X-axis direction.

According to an aspect of the present invention, in each of the four heads, the P nozzles are comprised of M strings extending in the X-axis direction respectively, and in each of the M strings, the P nozzles are arranged at a pitch M times longer than the first length. Further, with respect to one of the M strings, the other (M−1) strings are shifted by a length i times longer than the first length in the X-axis direction without overlapping. Moreover, M is a natural number equal to or greater than 2, and i is a natural number from 1 to (M−1).

According to the above features, it is possible to reduce the nozzle pitch of the head in the X-axis direction. For this reason, it is possible to increase the line density of the nozzles of the head in the X-axis direction.

The stage may hold a base having portions to be ejected, and in the case in which, by relatively moving the head groups in the Y-axis direction with respect to the base, at least one ejection nozzle of the plurality of ejection nozzles is positioned at regions corresponding to the portions to be ejected, a liquid material may be ejected from at least one ejection nozzle.

According to the above features, it is possible to selectively coat the material onto the portions to be ejected.

According to another aspect of the present invention, a planar shape of each of the portions to be ejected is approximately rectangular defined by longer sides and shorter sides, and the stage holds the base such that directions of the longer sides are parallel to the X-axis direction and directions of the shorter sides are parallel to the Y-axis direction. Further, in the case in which, by relatively moving the head groups in the Y-axis direction with respect to the base, at least two ejection nozzles of the plurality of ejection nozzles are almost simultaneously positioned at regions corresponding to the portions to be ejected, a liquid material is substantially simultaneously ejected from at least two ejection nozzles onto the portions to be ejected.

According to the above features, within a period at which the head group relatively moves in the Y-axis direction once, that is, within one scan period, the liquid material having a required volume can be ejected onto one portion to be ejected. This is because the plurality of nozzles simultaneously ejects the liquid material to one portion to be ejected.

Moreover, the present invention can be implemented in various aspects. For example, the present invention can be implemented in aspects such as a manufacturing device of a color filter substrate, a manufacturing device of an electroluminescent display device, a manufacturing device of a plasma display device, and the like.

An ejection method of the present invention comprises a step (a) of loading a base having portions to be ejected on a stage; and a step (b) of relatively moving a first head, a second head, a third head and a fourth head in a Y-axis direction with respect to the base, each head being provided with P ejection nozzles arranged such that a nozzle pitch of each of the heads in an X direction becomes a first length. Further, the step (b) comprises the step (b1) of relatively moving the first head, the second head, the third head, and the fourth head in the Y-axis direction with respect to the base, simultaneously with shifting an X coordinate of a reference nozzle of the second head by a length ½ times shorter than the first length with respect to an X coordinate shifted by a second length from an X coordinate of a reference nozzle of the first head, shifting an X coordinate of a reference nozzle of the fourth head by a length ½ times shorter than the first length with respect to an X coordinate shifted by the second length from an X coordinate of a reference nozzle of the third head, and shifting the X coordinate of the reference nozzle of the third head by a length ¼ times or ¾ times shorter than the first length with respect to an X coordinate shifted by the second length from the X coordinate of the reference nozzle of the second head. In addition, the step (b1) comprises a step of relatively moving one of the first head and the second head to the other continuously and relatively moving one of the third head and the fourth head to the other continuously. Moreover, P is a natural number equal to or greater than 2, and the second length is P/4 times shorter than the first length.

According to the above features, even though the ejected amount of liquid droplets from the nozzles in the heads for every nozzle position is different, the difference in the ejected amount does not appear in the stream of liquid droplets ejected from the head group. This is because the difference in the ejected amount is offset since the nozzles belonging to various regions of the heads are adjacent in the X-axis direction in the head group.

The step (b) may comprise a step (b2) of relatively moving the four heads, each having the P ejection nozzles arranged in the X-axis direction, in the Y-axis direction with respect to the base.

Further, the ejection method further comprises, in the case in which at least one nozzle of the plurality of nozzles are positioned at regions corresponding to the portions to be ejected by means of the step (b), a step (c) of ejecting a liquid material from at least one ejection nozzle onto the portions to be ejected.

According to the above features, it is possible to selectively coat the material onto the portions to be ejected.

According to another aspect of the present invention, a planar shape of each of the portions to be ejected is approximately rectangular defined by longer sides and shorter sides, and the step (a) comprises a step (a1) of loading the base such that directions of the longer sides of the respective portions to be ejected are parallel to the X-axis direction and directions of the shorter sides of the respective portions to be ejected are parallel to the Y-axis direction. In addition, the step (c) further comprises a step (c1) of, in the case in which, by relatively moving the head groups in the Y-axis direction with respect to the base, at least two ejection nozzles of the P ejection nozzles are almost simultaneously positioned at regions corresponding to the portions to be ejected, almost simultaneously ejecting a liquid material from at least two ejection nozzles onto the portions to be ejected.

According to the above features, within one scan period, the liquid material having a required volume can be ejected onto one portion to be ejected. This is because the plurality of nozzles ejects simultaneously the liquid material to one portion to be ejected.

DETAILED DESCRIPTION

First Embodiment

Hereinafter, an ejection device and an ejection method according to the present embodiment will be described according to an order described below.

A. Entire Construction of Ejection Device

B. Carriage

C. Head

D. Head Group

E. Control Unit

F. Example of Ejection Method

A. Entire Construction of Ejection Device

Figure 1:
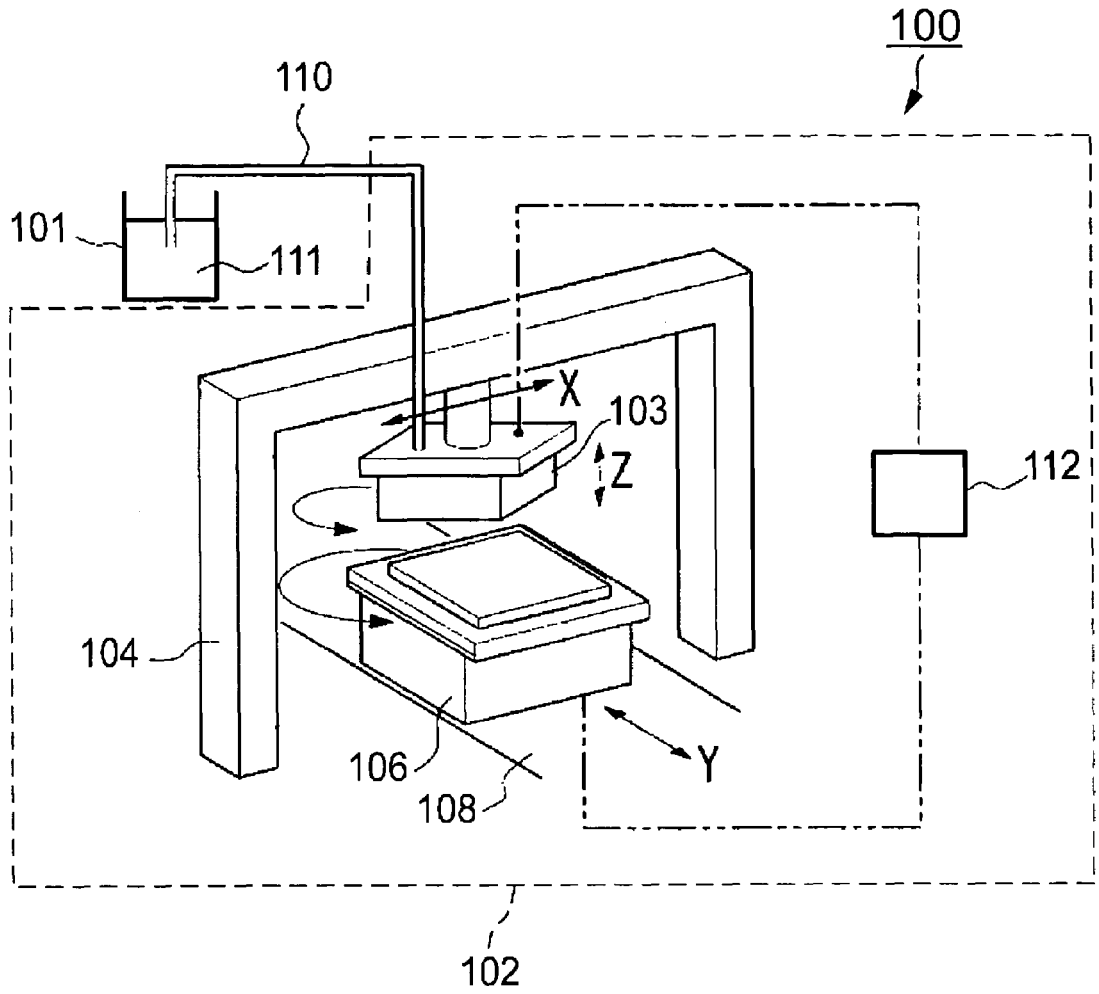
FIG. 1 is a schematic view showing an ejection device according to a first embodiment.

As shown in FIG. 1, an ejection device 100 comprises a tank for storing a liquid material 111, a tube 110, and an ejection scan unit 102 to which the liquid material 111 is supplied from the tank 101 via the tube 110. The ejection scan unit 102 comprises a carriage 103 for holding a plurality of heads 114 (FIG. 2), first position control means 104 for controlling a position of the carriage 103, a stage 106 for holding a base 10A, second position control means 108 for controlling a position of the stage 106, and a control unit 112. The tank 101 is connected to the plurality of heads 114 in the carriage 103 via the tube 110, such that the liquid material 111 is supplied from the tank to each of the plurality of heads 114 by means of compressed air.

The first position control means 104 moves the carriage 103 in an X-axis direction and a Z-axis direction orthogonal to the X-axis direction, in response to a signal from the control unit 112. In addition, the first position control means 104 has a function of rotating the carriage 103 around an axis parallel to the Z-axis. In the present embodiment, the Z-axis direction is a direction parallel to a vertical direction (that is, a direction of an acceleration of gravity). The second position control means 108 moves the stage 106 along a Y-axis direction orthogonal to both the X-axis direction and the Z-axis direction, in response to a signal from the control unit 112. In addition, the second position control means 108 has a function of rotating the stage 106 around an axis parallel to the Z-axis. Moreover, in the present specification, the first position control means 104 and the second position control means 108 may be referred to as 'a scan unit'.

The stage 106 has a plane parallel to both the X-axis direction and Y-axis direction. Further, the stage 106 is constructed to fix and hold the base onto a surface thereof, the base having portions to be ejected to which a predetermined material is to be coated. Moreover, in the present specification, the base having the portions to be ejected may be referred to as 'a receiving substrate'.

In the present specification, the X-axis direction, the Y-axis direction and the Z-axis direction accord to a direction in which one of the carriage 103 and the stage 106 relatively moves to the other. A virtual origin of an XYZ coordinate system defining the X-axis direction, the Y-axis direction and the Z-axis direction is fixed in a reference portion of the ejection device 100. In the present specification, an X coordinate, a Y coordinate and a Z coordinate are coordinates in such an XYZ coordinate system. Moreover, the virtual origin may be fixed in the stage 106 or the carriage 103, as well as the reference portion.

As described above, the carriage 103 is moved to the X-axis direction by means of the first position control means 104. Meanwhile, the stage 106 is moved to the Y-axis direction by means of the second position control means 108. That is, relative positions of the heads 114 to the stage 106 are changed by means of the first position control means 104 and the second position control means 108. More specifically, through such motions, the carriage 103, a head groups 114G (FIG. 2), the heads 114, or nozzles 118 (FIG. 3) moves relatively, that is, scans relatively, in the X-axis direction and the Y-axis direction with respect to the portion to be ejected on the stage 106 while maintaining a predetermined distance in the Z-axis direction. Here, the carriage 103 may move in the Y-axis direction with respect to the stationary portion to be ejected.

Further, during a period in which the carriage 103 moves between two predetermined points along the Y-axis direction, the material 111 may be ejected from the nozzles 118 to the stationary portion to be ejected.

The terms 'relative move' and 'relative scan' include moving of at least one of the side onto which the liquid material 111 is ejected and the side onto which the ejected material hits with respect to the other.

In addition, that the carriage 103, the head groups 114G (FIG. 2), the relative motion of the heads 114, or the nozzles 118 (FIG. 3) means that relative positions of these elements are changed with respect to the stage 106, the base, or the portion to be ejected. Thus, in the case in which, while the carriage 103, the head groups 114G, the heads 114, or the nozzles 118 is stationary to the ejection device 100, only the stage 106 moves, it is described in the present specification that the carriage 103, the head groups 114G, the heads 114, or the nozzles 118 relatively moves with respect to the stage 106, the base, or the portion to be ejected. Further, the relative scan or the relative move and the ejection of the material are incorporatively referred to as 'a coat scan'.

Besides, the carriage 103 and the stage 106 further have a degree of freedom on a parallel move and a rotation. However, in the present embodiment, the description on the degree of freedom other than the above-mentioned degree of freedom is omitted for simple explanation.

The control unit 112 is constructed to receive ejection data indicating a relative position onto which the liquid material 111 is to be ejected, from an external information processing device. The detailed construction and function of the control unit 112 will be described below.

B. Carriage

Figure 2:
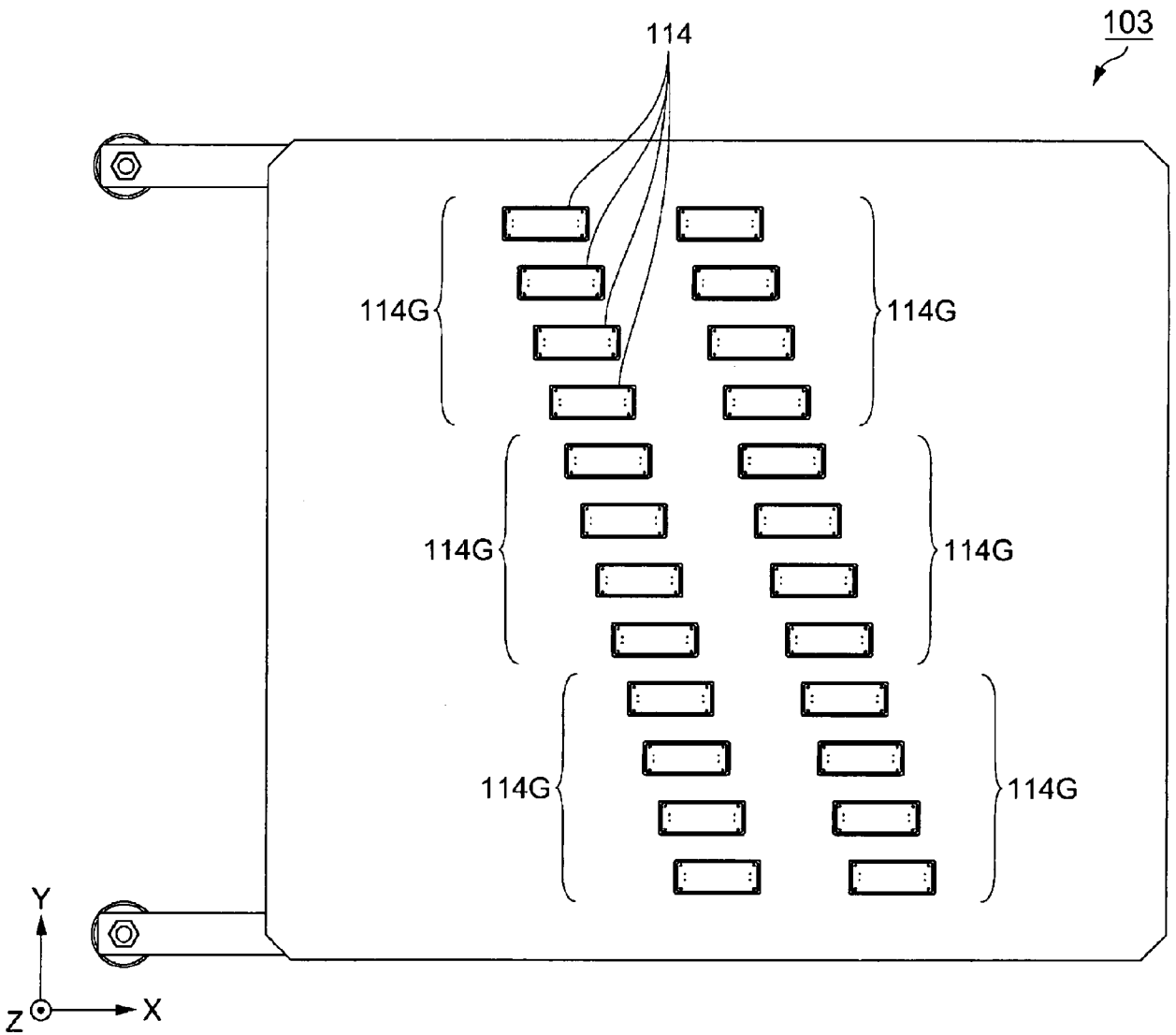
FIG. 2 is a schematic view showing a carriage of the first embodiment.

FIG. 2 is a view of the carriage 103 as being viewed from the side of the stage 106. A direction vertical to a paper of FIG. 2 is the Z-axis direction. Further, a right direction and a left direction of the paper of FIG. 2 is the X-axis direction and an upper direction and a lower direction of the paper of FIG. 2 is the Y-axis direction.

As shown in FIG. 2, the carriage 103 holds the plurality of heads 114, each having the approximately same structure. In the present embodiment, the number of the heads 114 to be held in the carriage 103 is 24. Each head 114 has a bottom surface on which the plurality of nozzles 118 to be described below is provided. The bottom surface of the head 114 is in a polygonal shape which has two longer sides and two shorter sides. As shown in FIG. 2, the bottom surface of the head 114 goes toward the side of the stage 106, and further the longer side direction and the shorter side direction of the head 114 are respectively parallel to the X-axis direction and the Y-axis direction. Moreover, the detailed relative position relationship among the heads 114 will be described.

In the present specification, four adjacent heads 114 in the Y-axis direction may be marked as 'the head group 114G'. According to such a mark, the carriage 103 of FIG. 2 holds six head groups 114G.

C. Head

Figure 3:
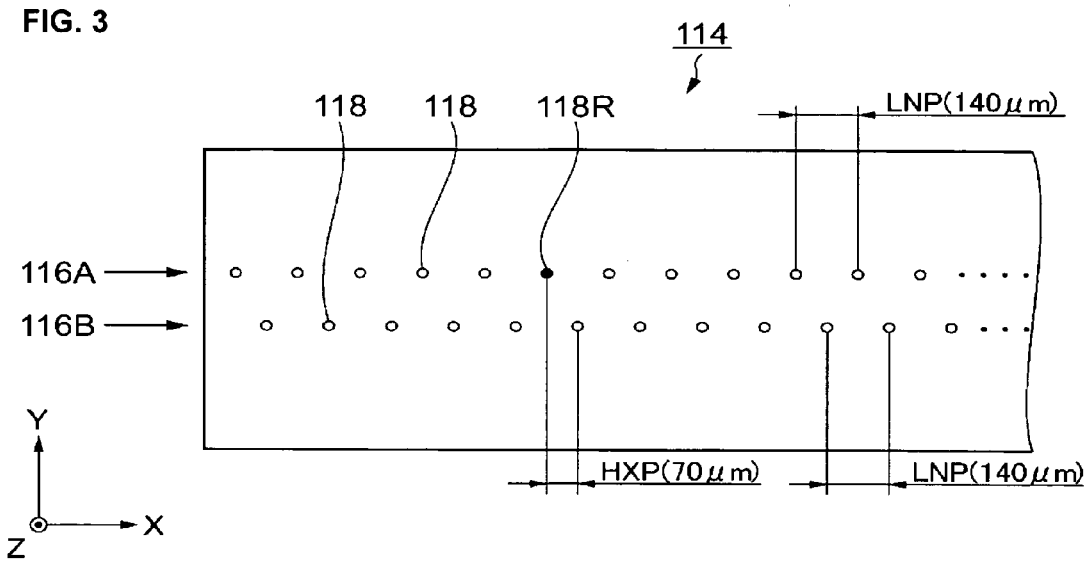
FIG. 3 is a schematic view showing a head of the first embodiment.

FIG. 3 shows the bottom surface of the head 114. The head 114 has the plurality of nozzles 118 arranged in the X-axis direction. The plurality of nozzles 118 are arranged such that a nozzle pitch HXP of the head 114 in the X-axis direction is about 70 $\mu$m. Here, 'the nozzle pitch HXP of the head 114 in the X-axis direction' corresponds to a pitch among the plurality of nozzle images which are obtained by projecting all the nozzles 118 in the head 114 onto the X-axis direction along the Y-axis direction.

In the present embodiment, the plurality of nozzles 118 in the head 114 is comprised of a nozzle string 116A and a nozzle string 116B both of which extend in the X-axis direction. The nozzle string 116A and the nozzle string 116B are arranged in the Y-axis direction. Further, in each of the nozzle string 116A and the nozzle string 116B, 90 nozzles are arranged in a row at a constant interval in the X-axis direction. In the present embodiment, the constant interval is about 140 $\mu$m. That is, the nozzle pitch LNP of the nozzle string 116A and the nozzle pitch LNP of the nozzle string 116B both are about 140 $\mu$m.

The position of the nozzle string 116B is shifted to a positive direction of the X-axis direction (a right direction of FIG. 3) by a half length (about 70 $\mu$m) of the nozzle pitch LNP with respect to the position of the nozzle string 116A. For this reason, the nozzle pitch HXP of the head 114 in X-axis direction is a half length (about 70 $\mu$m) of the nozzle pitch LNP of the nozzle string 116A (or the nozzle string 116B).

Therefore, a line density of the nozzles of the head 114 in the X-axis direction is two times as high as a line density of the nozzles of the nozzle string 116A (or the nozzle string 116B). Moreover, 'the line density of the nozzles in the X-axis direction' in the present specification corresponds to the number per unit length of the plurality of nozzle images obtained by projecting the plurality of nozzles onto the X-axis along the Y-axis direction.

Needless to say, the number of the nozzle strings included in the head 114 is not limited to two. The head 114 may include M nozzle strings. Here, M is a natural number equal to or greater than 1. In this case, in each of the M nozzle strings, the plurality of nozzles 118 are arranged at a pitch of a length M times shorter than the nozzle pitch HXP. In addition, if M is a natural number equal to or greater than 2, with respect to one of the M nozzle strings, other (M−1) nozzle strings are shifted to the X-axis direction by a length i times shorter than the nozzle pitch HXP without overlapping. Here, is a natural number from 1 to (M−1).

By the way, since the nozzle string 116A and the nozzle string 116B are respectively comprised of 90 nozzles, one head 114 has 180 nozzles. However, 5 nozzles disposed at both ends of the nozzle string 116A are respectively set as 'a pause nozzle'. Similarly, 5 nozzles disposed at both ends of the nozzle string 116B also are respectively set as 'a pause nozzle'. Thus, the liquid material 111 is not ejected from these 20 'pause nozzles'. For this reason, 160 nozzles 118 among the 180 nozzles 118 in the head 114 function as a nozzle of discharging the liquid material 111. In the present specification, these 160 nozzles 118 may be respectively referred to as 'an ejection nozzle'.

Moreover, the number of the nozzles 118 in one head 114 is not limited to 180. In one head 114, 360 nozzles may be provided. In this case, the nozzle string 116A and the nozzle string 116B may be respectively comprised of 180 nozzles 118. Further, in the present invention, the number of the ejection nozzles is not limited to 160. In one head 114, P ejection nozzles may be provided. Here, P is a natural number equal to or greater than 2. Further, P may be equal to or less than the total number of nozzles in the head 114.

In the present specification, for explaining the relative position relationship between the heads 114, the sixth nozzle 118 from the left among 90 nozzles 118 to be included in the nozzle string 116A is referred to as 'a reference nozzle 118R' of the head 114. That is, a leftmost ejection nozzle among 80 ejection nozzles 118 in the nozzle string 116A is 'the reference nozzle 118R' of the head 114. Moreover, since it is sufficient that a designation method of 'the reference nozzle 118R' with respect to all the heads 114 is the same, 'the reference nozzle 118R' may be not disposed at the above-mentioned position.

Figure 4:
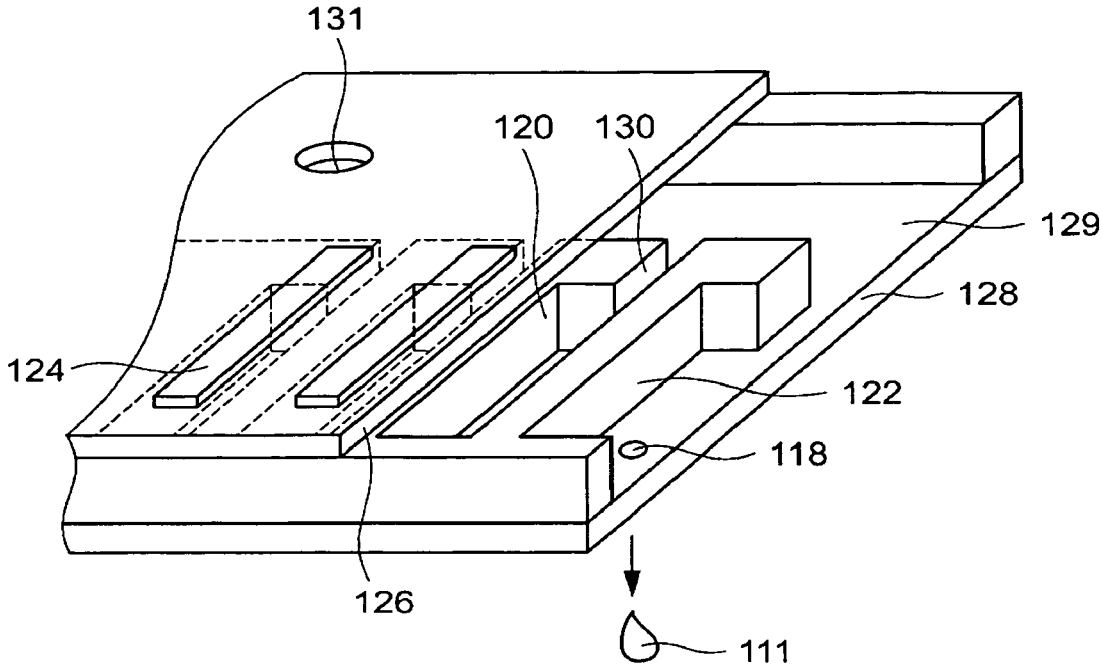
FIGS. 4(*a*) and 4(*b*) are schematic views showing an ejection unit of the head of the first embodiment.
Figure 4:
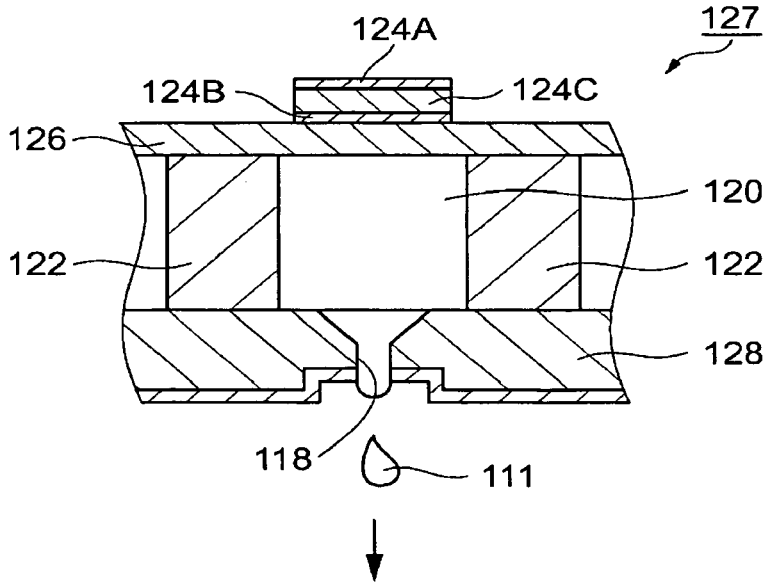

As shown in FIGS. 4(*a*) and 4(*b*), each head 114 is an ink jet head. More specifically, each head 114 comprises a vibration plate 126 and a nozzle plate 128. Between the vibration plate 126 and the nozzle plate 128, a trap 129 is disposed, with which the liquid material 111 to be supplied from the tank 101 via a hole 131 is filled.

Further, between the vibration plate 126 and the nozzle plate 128, a plurality of compartment walls 122 is disposed. In addition, cavities 120 are respectively defined by the vibration plate 126, the nozzle plate 128 and a pair of compartment walls 122. Since the cavities 120 are provided to correspond to the nozzles 118, the number of the cavities 120 and the number of the nozzles 118 are the same. To the respective cavities 120, the liquid material 111 is supplied from the trap 129 via a supply port 130 disposed between the pair of compartment walls 122.

On the respective vibration plates 126, vibrators 124 are disposed to correspond to the respective cavities 120. Each vibrator 124 comprises a piezo element 124C and a pair of electrodes 124A and 124B interposing the piezo element 124C therebetween. If a drive voltage is applied between the pair of electrodes 124A and 124B, the liquid material 111 from a corresponding nozzle 118 is ejected. Moreover, a shape of the nozzle 118 is adjusted such that the liquid material is ejected in the Z-axis direction from the nozzle 118.

Here, in the present specification, 'the liquid material' refers to a material having an enough viscosity to be ejected from the nozzles, irrespective of water-based material or oil-based material. It is necessary to have a proper liquidity (viscosity) capable of being ejected from the nozzles, and to prepare a liquid having mixed with a solid material.

The control unit 112 (FIG. 1) may be constructed to supply signals separately to each of the plurality of vibrators 124. That is, the volume of the liquid material 111 to be ejected from the nozzles 118 may be controlled for every nozzle 118 according to signals from the control unit 112. In this case, the volume of the liquid material 111 to be ejected from each of the nozzles 118 can be varied between 0 pl to 42 pl (picoliter). Further, as described below, the control unit 112 can also set the nozzles 118 which perform the ejection operation and the nozzles 118 which do not perform the ejection operation during the coat scan.

In the present specification, a portion including one nozzle 118, the cavity 120 corresponding to the nozzle 118, and the vibrator 124 corresponding to the cavity 120 may be marked as 'a ejection unit 127'. According to such a mark, one head 114 has the same number of the ejection units 127 as that of the nozzles 118. The respective ejection units 127 may have an electrothermal conversion element, instead of a piezo element. That is, the respective ejection units 127 may be constructed to ejection the material using a thermal expansion of the material by the electrothermal conversion element.

D. Head Group

Figure 5:
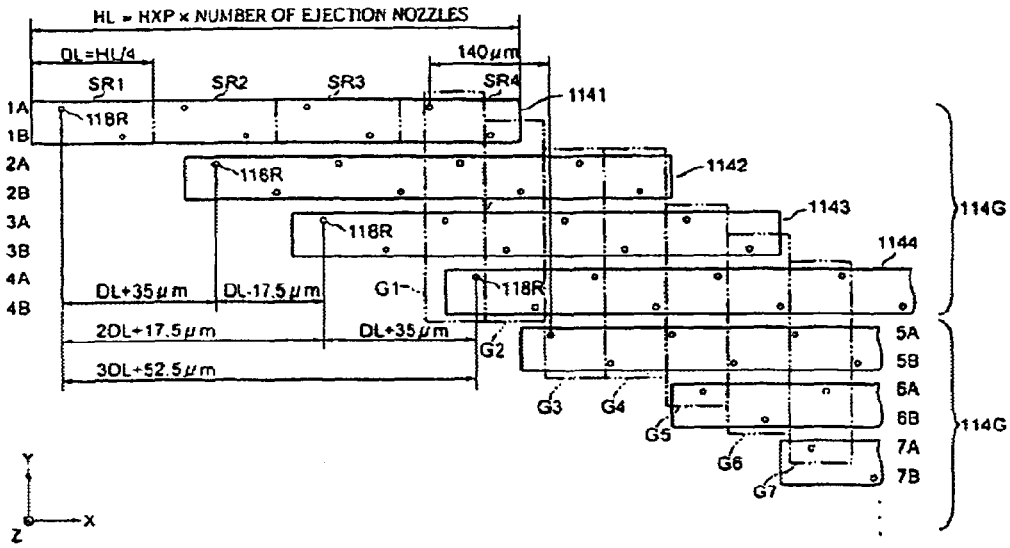
FIG. 5 is a schematic view showing a relative position relationship of the head in a head group of the first embodiment.

Next, a relative position relationship of four heads 114 in the head group 114G will be described. In FIG. 5, two adjacent head groups 114G in the Y-axis direction in the carriage 103 of FIG. 2 are shown.

As shown in FIG. 5, the respective head groups 114G are made of four heads 114. Further, four heads 114 in the head group 114G are arranged such that the nozzle pitch GXP of the head group 114G in the X-axis direction has a length ¼ times shorter than the nozzle pitch HXP of the head 114 in the X-axis direction. In the present embodiment, since the nozzle pitch HXP of the head 114 in the X-axis direction is about 70 $\mu$m, the nozzle pitch GXP of the head group 114G in the X-axis direction is about 17.5 $\mu$m which is ¼ times shorter than the nozzle pitch HXP of the head 114 in the X-axis direction. Here, 'the nozzle pitch GXP of the head group 114G in the X-axis direction' corresponds to a pitch between the plurality of nozzle images obtained by projecting all the nozzles 118 in the head group 114G onto the X-axis along the Y-axis direction.

Needless to say, the number of the heads 114 included in the head group 114G is not limited to four. The head group 114G may be comprised of N heads 114. Here, N is a natural number equal to or greater than 2. In this case, N heads 114 in the head group 114G may be arranged such that the nozzle pitch GXP is 1/N times shorter than the nozzle pitch HXP.

Hereinafter, the relative position relationship of the heads 114 of the present embodiment will be more specifically described.

To begin with, for simple explanation, four heads 114 included in the head group 114G disposed at an upper left of FIG. 5 are respectively marked as a head 1141, a head 1142, a head 1143 and a head 1144 from above. Similarly, four heads 114 included in the head group 114G disposed at a lower right of FIG. 5 are respectively marked as a head 1145, a head 1146, a head 1147 and a head 1148 from above.

Further, the nozzle strings 116A and 116B in the head 1141 are marked as nozzle strings 1A and 1B respectively, and the nozzle strings 116A and 116B in the head 1142 are marked as nozzle strings 2A and 2B respectively. In addition, the nozzle strings 116A and 116B in the head 1143 are marked as nozzle strings 3A and 3B respectively, and the nozzle strings 116A and 116B in the head 1144 are marked as nozzle strings 4A and 4B respectively. Similarly, the nozzle strings 116A and 116B in the head 1145 are marked as nozzle strings 5A and 5B respectively, and the nozzle strings 116A and 116B in the head 1146 are marked as nozzle strings 6A and 6B respectively. In addition, the nozzle strings 116A and 116B in the head 1147 are marked as nozzle strings 7A and 7B respectively, and the nozzle strings 116A and 116B in the head 1148 are marked as nozzle strings 8A and 8B respectively.

The respective nozzle strings 1A to 8B are actually comprised of 90 nozzles 118. Further, as described above, in the respective nozzle strings 1A to 8B, 90 nozzles 118 are arranged in the X-axis direction. However, in FIG. 5, for explanatory convenience, the nozzle strings 1A to 8B each comprising four ejection nozzles (the nozzle 118) are shown. In addition, in FIG. 5, the leftmost nozzle 118 of the nozzle string 1A is the reference nozzle 118R of the head 1141, and the leftmost nozzle 118 of the nozzle string 2A is the reference nozzle 118R of the head 1142. Further, the leftmost nozzle 118 of the nozzle string 3A is the reference nozzle 118R of the head 1143, the leftmost nozzle 118 of the nozzle string 4A is the reference nozzle 118R of the head 1144, and the leftmost nozzle 118 of the nozzle string 5A is the reference nozzle 118R of the head 1145.

In the present embodiment, a product of the nozzle pitch HXP of the head 114 in the X-axis direction and the number of the ejection nozzles in the head 114 is referred to as 'an effective length HL of the head'. In the example of FIG. 5, since the nozzle pitch HXP is 70 $\mu$m and the number of the ejection nozzles is 8, the effective length HL of the head is 560 $\mu$m. Further, in the present embodiment, one head 114 is made of four consecutive sub regions SR. A length DL of each sub region SR in the X-axis direction is ¼ times shorter than the effective length HL of the head. Hereinafter, for explanatory convenience, four sub regions SR of the head 114 are marked as sub regions SR1, SR2, SR3 and SR4 respectively toward a positive direction of the X-axis direction (a right direction in FIG. 5).

Based on such marks, an X coordinate of the reference nozzle of each head 114 is expressed as follows.

With respect to an X coordinate shifted by the length DL from the X coordinate of the reference nozzle 118R of the head 1141, the X coordinate of the reference nozzle 118R of the head 1142 is further shifted by a length ½ times shorter than the nozzle pitch HXP. In the example of FIG. 5, the X coordinate of the reference nozzle 118R of the head 1142 is shifted in the positive direction of the X-axis direction (the right direction in FIG. 5) by a length, which is a sum of a length ½ times shorter than the nozzle pitch HXP and the length DL, with respect to an X coordinate of the reference nozzle 118R of the head 1141.

With respect to an X coordinate shifted by the length DL from an X coordinate of the reference nozzle 118R of the head 1143, an X coordinate of the reference nozzle 118R of the head 1144 is further shifted by a length ½ times shorter than the nozzle pitch HXP. In the example of FIG. 5, the X coordinate of the reference nozzle 118R of the head 1144 is shifted in the positive direction of the X-axis direction (the right direction in FIG. 5) by a length, which is a sum of a length ½ times shorter than the nozzle pitch HXP and the length DL, with respect to the X coordinate of the reference nozzle 118R of the head 1143.

With respect to the X coordinate shifted by the length DL from the X coordinate of the reference nozzle 118R of the head 1142, the X coordinate of the reference nozzle 118R of the head 1143 is further shifted by a length ¼ times or ¾ times shorter than the nozzle pitch HXP. In the example of FIG. 5, a position of the reference nozzle 118R of the head 1143 is shifted in the positive direction of the X-axis direction (the right direction in FIG. 5) by a length, which is a subtraction of a length ½ times shorter than the nozzle pitch HXP from the length DL, with respect to the X coordinate of the reference nozzle 118R of the head 1143. Moreover, the description of 'a shift in the X-axis direction' includes a shift in a negative direction of the X-axis direction, as well as a shift in the positive direction of the X-axis direction.

Further, in the present embodiment, the heads 1141, 1142, 1143 and 1144 are arranged in order toward a negative direction of the Y-axis direction (a lower direction in FIG. 5). However, an order of these four heads arranged in the Y-axis direction is not limited to the order of the present embodiment. More specifically, only if the head 1141 and the head 1142 are adjacent to each other in the Y-axis direction and the head 1143 and the head 1144 are adjacent to each other in the Y-axis direction, respectively, any arrangement may be used.

An arrangement, that is, a configuration, of the heads 1145, 1146, 1147 and 1148 in the head group 114G disposed at a lower right of FIG. 5 is the same as the arrangement of the heads 1141, 1142, 1143 and 1144.

A relative position relationship between two adjacent head groups 114G in the X-axis direction will be described based on the relative position relationship between the head 1145 and the head 1141.

An X coordinate of the reference nozzle 118R of the head 1145 is shifted in the positive direction of the X-axis direction by a length, which is a product of the nozzle pitch HXP of the head 114 in the X-axis direction and the number of the ejection nozzles in the head 114, from the X coordinate of the reference nozzle 118R of the head 1141. In the present embodiment, since the nozzle pitch HXP is about 70 μm and the number of the ejection nozzles in one head 114 is 160, the X coordinate of the reference nozzle 118R of the head 1145 is shifted in the positive direction of the X-axis direction by 11.2 mm (70 μm×160) from the X coordinate of the reference nozzle 118R of the head 1141. However, in the FIG. 5, for explanatory convenience, since the number of the ejection nozzles in the head 1141 is 8, it is shown that the X coordinate of the reference nozzle 118R of the head 1145 is shifted by 560 μm (70 μm×8) from the X coordinate of the reference nozzle 118R of the head 1141.

Since the head 1141 and the head 1145 are arranged as described above, an X coordinate of the rightmost ejection nozzle of the nozzle string 1A and an X coordinate of the leftmost ejection nozzle of the nozzle string 5A are shifted to each other by the nozzle pitch LNP. For this reason, a nozzle pitch of all of two head groups 14G in the X-axis direction is ¼ times shorter than the nozzle pitch HXP of the head 114 in the X-axis direction.

Six head groups 114G are arranged such that a nozzle pitch of the carriage 103 as a whole in the X-axis direction is also 17.5 μm, that is, a length ¼ times shorter than the nozzle pitch HXP of the head 114 in the X-axis direction.

Moreover, in the present specification, the heads 114 disposed at both ends of one head group 114G, such as the head 1141, the head 1143 and the head 1145, may be referred to as 'a reference head'.

In the present embodiment, portions in which the X coordinates of four nozzles 118 are fitted within the range of the length the nozzle pitch HXP along the X-axis direction are referred to as an overlapping portion G (in FIG. 5, G1 to G7). For example, in FIG. 5, the overlapping portion G1 includes the rightmost nozzle 118 of the nozzle string 1A, the third nozzle 118 from the right in the nozzle string 2A, the second nozzle 118 from the left in the nozzle string 3A, and the leftmost nozzle 118 of the nozzle string 4A. Similarly, the overlapping portion G2 includes the rightmost nozzle 118 of the nozzle string 1B, the second nozzle 118 from the right in the nozzle string 2B, the second nozzle 118 from the left in the nozzle string 3B, and the leftmost nozzle 118 of the nozzle string 4B. Further, the overlapping portion G3 includes the rightmost nozzle 118 of the nozzle string 2A, the rightmost nozzle 118 of the nozzle string 3A, the rightmost nozzle 118 of the nozzle string 4A, and the leftmost nozzle 118 of the nozzle string 5A.

According to the head arrangement of the present embodiment, the overlapping portions G1 to G7 all include the nozzle 118 belonging to the sub region SR1, the nozzle 118 belonging to the sub region SR2, the nozzle 118 belonging to the sub region SR3, and the nozzle 118 belonging to the sub region SR4. Besides, the respective numbers of the nozzles in the respective sub region SR1, the sub region SR2, the sub region SR3 and the sub region SR4 to be included in one overlapping portion (for example, the overlapping portion G1) are the same. For example, in the example of FIG. 5, the overlapping portion G1 includes the nozzle 118 belonging to the sub regions SR4, the nozzle 118 belonging to the sub region SR3, the nozzle 118 belonging to the sub region SR2 and the nozzle 118 belonging to the SR1 by ones.

In addition, according to the head arrangement of the present embodiment, the X coordinate of the rightmost nozzle 118 of the nozzle string 1B is approximately aligned to a halfway between the X coordinate of the rightmost nozzle 118 of the nozzle string 1A and the X coordinate of the leftmost nozzle 118 of the nozzle string 5A. Further, the X coordinate of the second nozzle 118 from the right in the nozzle string 2A is approximately aligned to a halfway between the X coordinate of the rightmost nozzle 118 of the nozzle string 1A and the X coordinate of the rightmost nozzle 118 of the nozzle string 1B. The X coordinate of the second nozzle 118 from the left in the nozzle string 2A is approximately aligned with a halfway between the X coordinate of the rightmost nozzle 118 of the nozzle string 1A and the X coordinate of the second nozzle 118 from the right in the nozzle string 2A. The X coordinate of the second nozzle 118 from the left in the nozzle string 3A is approximately aligned with a halfway between the X coordinate of the rightmost nozzle 118 of the nozzle string 1A and the X coordinate of the second nozzle 118 from the right in the nozzle string 2A. The X coordinate of the leftmost nozzle 118 of the nozzle string 4A is approximately aligned with a halfway between the X coordinate of the second nozzle from the right in the nozzle string 2A and the X coordinate of the rightmost nozzle 118 of the nozzle string 1B.

E. Control Unit

Figure 6:
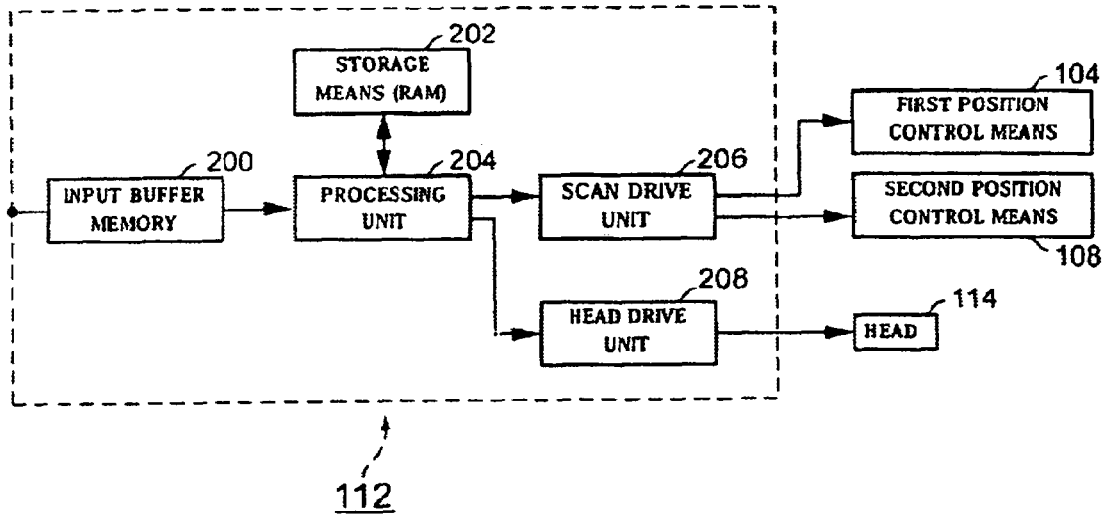
FIG. 6 is a schematic view showing a control unit of the first embodiment.

Next, a construction of the control unit will be described. As shown in FIG. 6, the control unit 112 comprises an input buffer memory 200, storage means 202, a processing unit 204, a scan drive unit 206, and a head drive unit 208. The buffer memory 200 and the processing unit 204 are communicatably connected to each other. The processing unit 204 and the storage means are communicatably connected to each other. The processing unit 204 and the scan drive unit 206 are communicatably connected to each other. The processing unit 204 and the head drive unit 208 are communicatably connected to each other. Further, the scan drive unit 206 is communicatably connected to the first position control means 104 and the second position control means 108. Similarly, the head drive unit 208 is communicatably connected to each of the plurality of heads 114.

The input buffer memory 200 receives ejection data for performing an ejection of liquid droplets of the liquid material 111 from the external information processing device. Ejection data includes data indicating relative positions of the base of the portions to be ejected, data indicating the times of relative scans required for coating the liquid material 111 onto all the portions to be ejected up to a desired thickness, data designating the nozzles 118 functioning as nozzles 118A to be turned on, and data designating the nozzles 118B to be turned off. The description of the nozzles 118A to be turned on and the nozzles 118B to be turned off will be described later. The input buffer memory 200 supplies ejection data to the processing unit 204, and the processing unit 204 stores ejection data in the storage means 202. In FIG. 6, the storage means 202 is a RAM.

The processing unit 204 supplies data indicating the relative positions of the nozzles 118 to the portions to be ejected to the scan drive unit 206, based on ejection data stored in the storage means 202. The scan drive unit 206 supplies the first position control means 104 and the second position control means 108 with a drive signal according to data indicating the relative positions of the nozzles 118 and an ejection period EP (FIG. 7) described below. As a result, the heads 114 scans relatively to the portions to be ejected. Meanwhile, the processing unit 204 supplies selection signals SC designating on/off of the nozzles 118 every ejection timing to the head drive unit 208, based on ejection data stored in the storage means 202 and the ejection period EP. The head drive unit 208 supplies ejection signals ES required for the ejection of the liquid material 111 to the heads 114, based on the selection signals SC. As a result, the liquid material 111 is ejected from corresponding nozzles 118 in the head 114 as liquid droplets.

The control unit 112 may be comprised of a computer including a CPU, a ROM and a RAM. In this case, the functions of the control unit 112 are implemented by software programs which the computer runs. Needless to say, the control unit 112 may be implemented by dedicated circuits (hardware).

Next, a construction of the head drive unit 208 in the control unit 112 will be described.

Figure 7A:
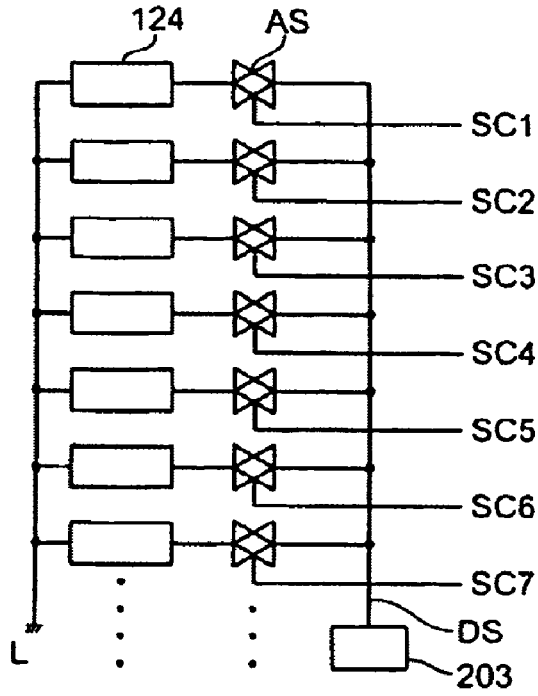
FIG. 7(*a*) is a schematic view showing a head drive unit of the first embodiment, and FIG. 7(*b*) is a timing chart showing a drive signal, selection signals and ejection signals in the head drive unit.
Figure 7B:
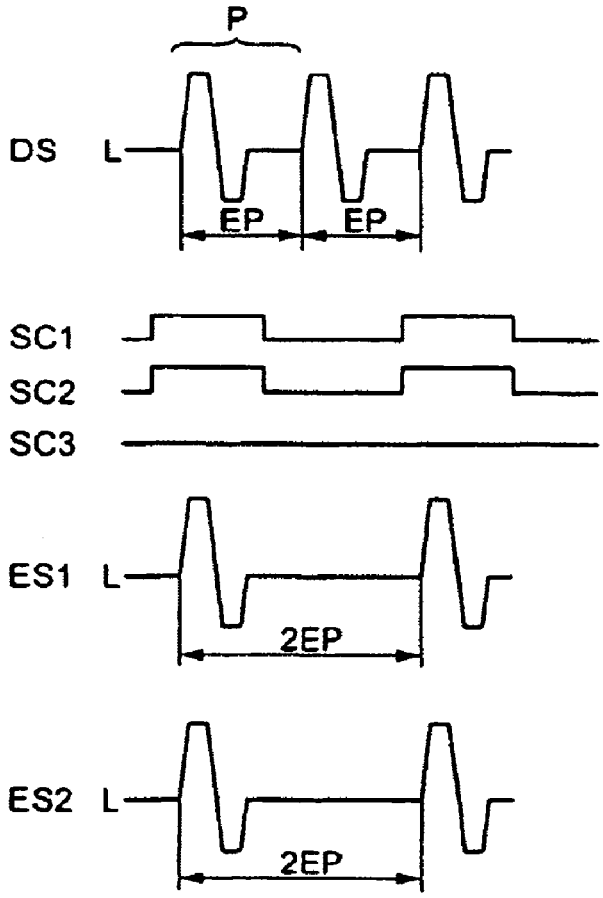

As shown in FIG. 7(*a*), the head drive unit 208 has one drive signal generating unit 203, and a plurality of analog switches AS. As shown in FIG. 7(*b*), the drive signal generating unit 203 generates the drive signal DS. A potential of the drive signal DS is varied according to a time with respect to a reference potential L. More specifically, the drive signal DS includes a plurality of ejection waveforms P which are repeated at the ejection period EP. Here, the ejection waveform P corresponds to a drive voltage waveform to be applied between a pair of electrodes of the vibrator 124 so as to eject one liquid droplet from the nozzle 118.

The drive signal DS is supplied to input terminals of the respective analog switches AS. The respective analog switches AS are provided to correspond to the respective ejection units 127. That is, the number of the analog switches AS and the number of the ejection units 127 (that is, the number of the nozzles 118) are the same.

The processing unit 204 supplies the selection signals SC (SC1, SC2, . . . in FIG. 7) indicating on/off of the nozzles 118 to the respective analog switches AS. Here, the selection signals SC have high level state or low level state separately every analog switch AS.

Meanwhile, the respective analog switches AS supply the ejection signals ES (ES1, ES2, . . . in FIG. 7) to the electrodes 123A of the vibrators 124 according to the drive signal DS and the selection signals SC. More specifically, when the selection signal SC is high level, the analog switch AS transmits the drive signal DS to the electrode 124A as the ejection signal ES. Meanwhile, when the selection signal SC is low level, a potential of the ejection signal ES to be outputted from the analog switch AS becomes a reference potential L. If the drive signal DS is supplied to the electrode 124A of the vibrator 124, the liquid material 111 is ejected from the nozzle 118 which corresponds to the vibrator 124.

Moreover, to the electrodes 124B of the respective vibrator 124, the reference potential L is supplied.

In the example shown in FIG. 7(*b*), a period of high level and a period of low level are set in each of two selection signals SC1 and SC2 such that in each of two ejection signals ES1 and ES2, ejection waveforms P appears at a period 2EP which is two times as large as the ejection period EP. Thus, the liquid material 111 is ejected from each of two corresponding nozzles 118 at the period 2EP. Further, to each of the vibrators 124 corresponding to these two nozzles 118, the drive signal DS is commonly supplied from the drive signal generating unit 203. For this reason, the liquid material 111 is ejected from two nozzles 118 at the approximately equal timing.

According to such a construction, the ejection device 100 performs the coat scan of the liquid material 111 according to ejection data supplied from the control unit 112.

F. Example of Ejection Method

Figure 8A:
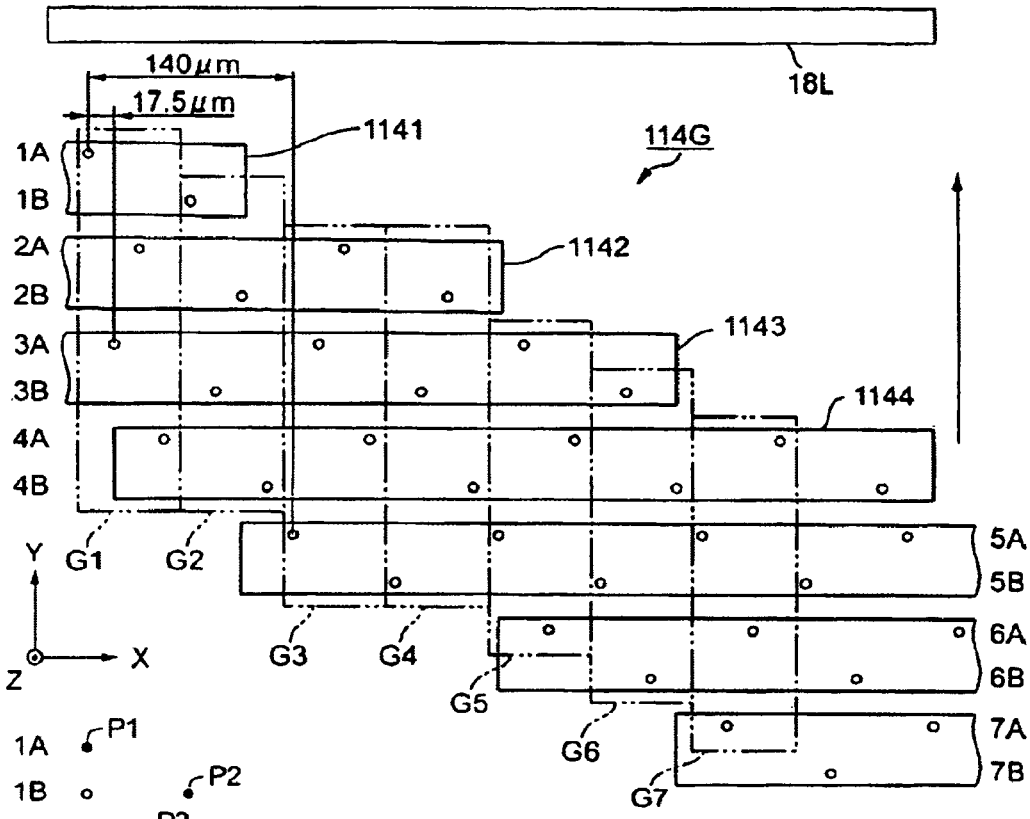
FIGS. 8(*a*) and 8(*b*) are schematic views showing an order of the ejections of the liquid droplets from the head group of the first embodiment.
Figure 8B:
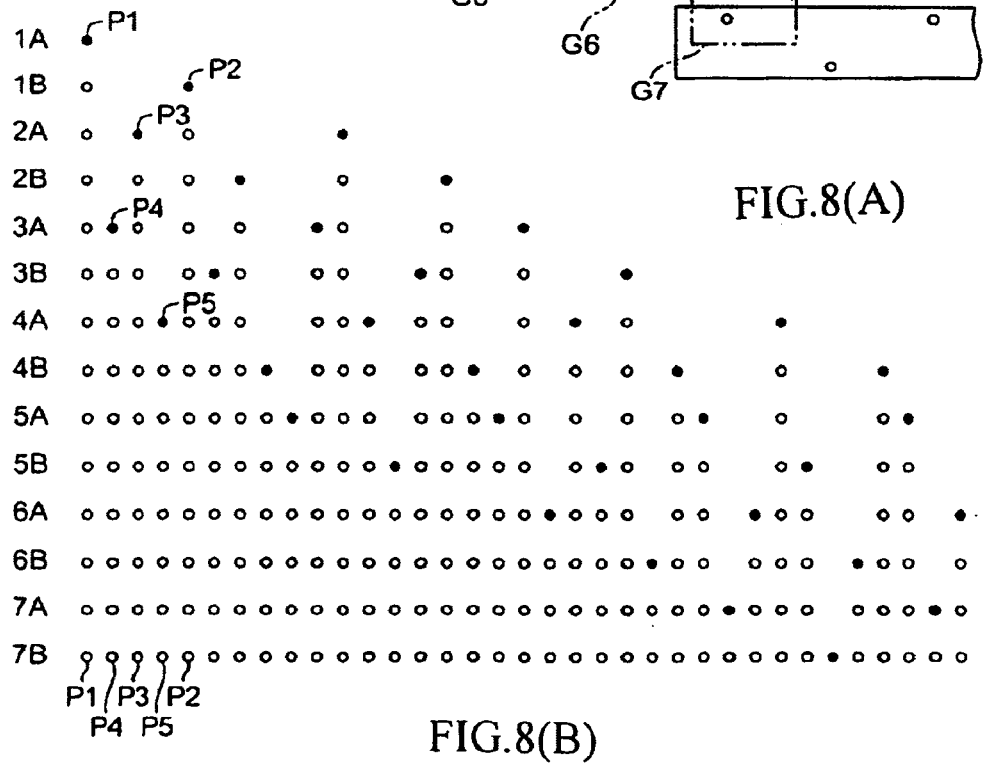

Referring to FIGS. 8(*a*) and 8(*b*), a method in which the ejection device 100 ejects the liquid material 111 to a target of a stripe shape parallel to the X-axis direction, that is, the portion to be ejected 18L will be described. Moreover, in the example shown in FIG. 8(*a*), by the relative move of the carriage 103 to the Y-axis direction, the heads 1141, 1142, 1143, 1144, 1145, 1146 and 1147 described in FIG. 5 sequentially overlap with the portion to be ejected 18L. Further, in FIG. 8, the overlapping portions G1 to G7 in FIG. 5 also are shown.

As shown in FIG. 8(*a*), first, the carriage 103 starts out to relatively move to the Y-axis direction with respect to the stage 106. Subsequently, if the nozzle string 1A overlaps the portion to be ejected 18L, the liquid material 111 is ejected from the nozzles 118 to be included in the overlapping portion G1 among the nozzles 118 of the nozzle string 1A onto the portion to be ejected 18L. In the right side of the label '1A' of FIG. 8(*b*), a hit position by the ejection of the nozzle string 1A is shown in a black circle. As shown in FIG. 8(*b*), by the ejection of the nozzle string 1A, the liquid material 111 hits onto the portion 18L to be ejected at a pitch of about 140 μm in the X-axis direction.

Next to the nozzle string 1A, the nozzle string 1B overlaps the portion to be ejected 18L. If the nozzle string 1B overlaps the portion to be ejected 18L, the liquid material 111 is ejected from the nozzles 118 to be included in the overlapping portion G1 among the nozzles 118 of the nozzle string 1B onto the portion to be ejected 18L. In the right side of the label '1B' in FIG. 8(*b*), a hit position by the ejection of the nozzle string 1B is shown in a black circle. Further, the hit position by the ejection of the nozzle string preceding the nozzle string 1B is shown in a white circle.

Next to the nozzle string 1B, the nozzle string 2A overlaps the portion to be ejected 18L. If the nozzle string 2A overlaps the portion to be ejected 18L, the liquid material 111 is ejected simultaneously from the nozzles 118 to be included in the overlapping portion G1, the nozzles 118 to be included in the overlapping portion G2, the nozzles 118 to be included in the overlapping portion G3 and the nozzles 118 to be included in the overlapping portion G4 among the nozzles 118 of the nozzle string 2A onto the portion to be ejected 18L. In the right side of the label '2A' in FIG. 8(*b*), hit positions by the ejection of the nozzle string 2A are shown in black circles. Further, hit positions by the nozzle strings preceding the nozzle string 2A are shown in white circles.

Next to the nozzle string 2A, the nozzle string 2B overlaps the portion 18L to be ejected. If the nozzle string 2B overlaps the portion 18L to be ejected, the liquid material 111 is ejected simultaneously from the nozzles 118 to be included in the overlapping portion G1, the nozzles 118 to be included in the overlapping portion G2, the nozzles 118 to be included in the overlapping portion G3 and the nozzles 118 to be included in the overlapping portion G4 among the nozzles 118 of the nozzle string 2B onto the portion to be ejected 18L. In the right side of the label '2B'in FIG. 8(*b*), hit positions by the ejection of the nozzle string 2B are shown in black circles. Further, hit positions by the nozzle strings preceding the nozzle string 2B are shown in white circles.

Subsequently, the nozzle strings 3A, 3B, 4A, 4B, 5A, 5B, 6A, 6B, 7A and 7B sequentially overlap the portion to be ejected 18L, and the liquid material 111 is ejected from the respective nozzle strings 3A, 3B, 4A, 4B, 5A, 5B, 6A, 6B, 7A and 7B onto the portion to be ejected 18L, like the nozzle strings 1A, 1B, 2A and 2B. As a result, during a period in which the head group 114G relatively moves to the Y-axis direction with respect to the portion to be ejected 18L just once, the liquid material 111 hits at a pitch of a length ¼ times shorter than the nozzle pitch HXP of the head 114 in the X-axis direction, that is, 17.5 μm.

One of the examples of the stripe-shaped portion to be ejected 18L is a portion for forming a metallic wiring. Therefore, the ejection device 100 of the present embodiment can be applied to a wiring manufacturing device which manufactures the metallic wiring by ejecting a liquid wiring material. For example, in a plasma display device 50 (FIGS. 20 to 22) described below, it can be applied to a wiring manufacturing device which forms address electrodes 54 on a supporting substrate 52.

Figure 30A:
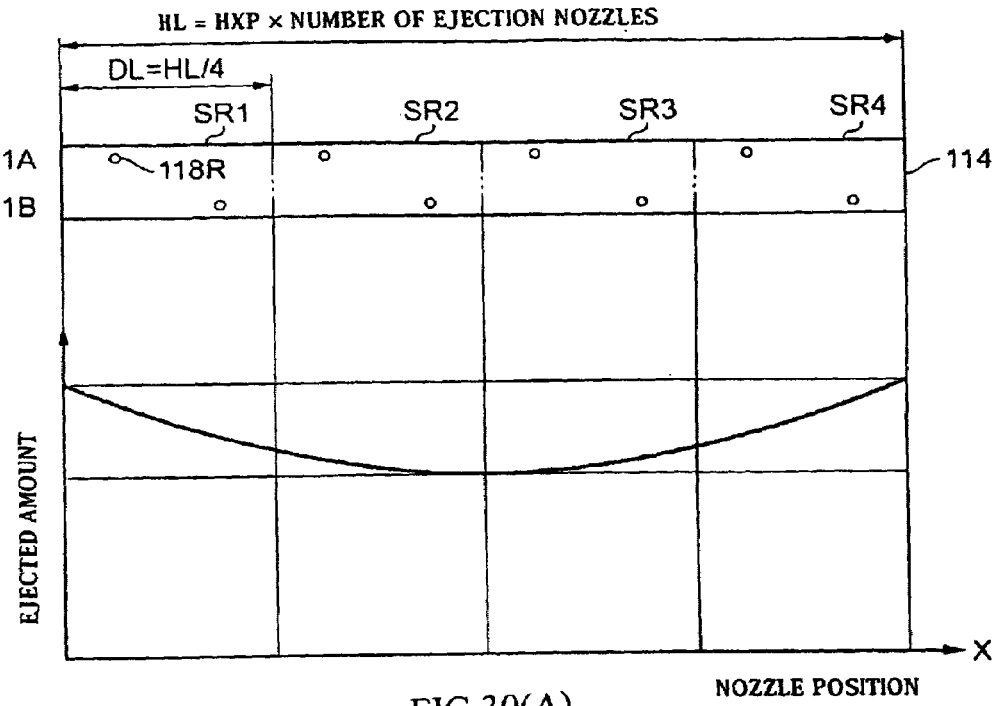
FIGS. 30(*a*) and (*b*) are graphs showing schematically a profile of the ejected amount in the first embodiment.
Figure 30B:
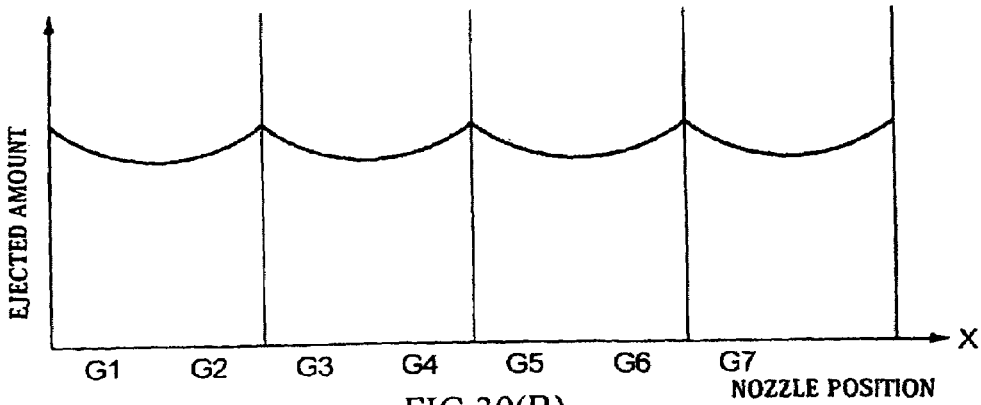

FIG. 30(*a*) is a graph showing schematically a profile of the ejected amount of the head 114 along the X-axis direction. Meanwhile, FIG. 30(*b*) is a graph showing schematically a profile of the ejected amount of the overlapping portions G1 to G7 in the head group 114G along the X-axis direction. In the graphs of FIGS. 30(*a*) and 30(*b*), the respective horizontal axes are in parallel with the X-axis and correspond with the position of the nozzles 118 in the head 114. Meanwhile, in the graphs of FIGS. 30(*a*) and 30(*b*), the respective vertical axes represent the ejected amount from the nozzle 118. Further, the profile of the ejected amount obtained by interpolating measured values is shown within the range of the effective length HL of the head described in FIG. 5.

As shown in FIG. 30(*a*), the ejected amount from the nozzles 118 disposed at both ends of the head 114 is most, and the ejected amount from the nozzles 118 disposed at an approximately center of the head 114 is least. Further, the shape of the profile of the ejected amount from the nozzles 118 along the X-axis direction is approximately symmetric with respect to the center of the head. This is because it depends on a manufacturing process of the head 114. In the present specification, the detailed description thereon will be omitted.

Meanwhile, as shown in FIG. 30(*b*), the profile of the ejected amount of the overlapping portions G1 to G7 along the X-axis direction has a shape to be repeated at a period of approximately ¼ times (that is, the length DL) shorter than the effective length HL of the head. This reason is as follows.

As described with reference to FIG. 5, with respect to the X coordinate of the reference nozzle 118 of one of four heads 114 arranged in the Y-axis direction, the X coordinates of the reference nozzles 118R of three other heads 114 are shifted by approximately integer times longer than the length DL to the X-axis direction without overlapping.

Besides, according to the head arrangement of the present embodiment, all the overlapping portions G (in FIG. 5, G1 to G7) include the nozzles 118 belonging to the sub region SR1, the nozzles 118 belonging to the sub region SR2, the nozzles 118 belonging to the sub region SR3 and the nozzles 118 belonging to the sub region SR4. For this reason, the nozzles 118 belonging to various sub regions SR of the head 114 are adjacent in the X-axis direction. In addition, the numbers of the nozzles of the respective sub regions SR1, SR2, SR3 and SR4 to be included in one overlapping portion G are the same. For this reason, onto a line parallel to the X-axis direction, that is, one stripe-shaped portion to be ejected 18L, an overall volume of the liquid droplets to be ejected from each of the overlapping portions G1 to G7 is approximately the same.

Therefore, the profile of the ejected amount of the overlapping portions G1 G2 along the X-axis direction, the profile of the ejected amount of the overlapping portions G3 G4 along the X-axis direction, the profile of the ejected amount of the overlapping portions G5 G6 along the X-axis direction, and the profile of the ejected amount of the overlapping portions G7 G8 along the X-axis direction are the approximately same shape. Moreover, the length of the X-axis direction corresponding to two adjacent overlapping portions G is equal to the length DL.

As described above, according to present embodiment, as shown in FIG. 30(*b*), even though the ejected amount of the liquid droplets from the respective nozzles 118 of the head 114 are different according to the positions of the nozzles 118, the difference in the ejected amount hardly appear on the stream of the liquid droplets ejected from the head group 114G. This is because the nozzles 118 belonging to various sub regions SR are adjacent to each other in the X-axis direction in the head group 114G, such that the difference in the ejected amount is offset. In addition, within the range of the effective length HL of the head, 8 overlapping portions are arranged. Therefore, the difference in the ejected amount along the X-axis direction within the range of the effective length HL of the head 114 becomes smaller.

Here, with respect to a direction in which the head group 114G relatively moves, a hit sequence of the liquid droplets of the liquid material 111 in the overlapping portion G, in which the reference nozzle is located at the top, is as follow. To begin with, the liquid droplets hit onto two positions spaced apart by a predetermined distance from each other. Subsequently, next liquid droplet hits onto an intermediate position between two positions which are already covered with the liquid droplets. And then, a pattern of such hit positions is repeated. For example, first, liquid droplets respectively hit onto P1 and P2 spaced by the nozzle pitch HXP in the X-axis direction from each other by the overlapping portions G1 and G2. Next, a liquid droplet hit onto P3 disposed at a halfway between P1 and P2. In addition, a liquid droplet hits onto P4 disposed at a halfway between P1 and P3. And then, a liquid droplet hits onto P5 disposed at a halfway between P3 and P2.

As described above, according to the head arrangement of the present embodiment, a liquid droplet contacts two liquid droplets hit in advance onto two positions which are symmetric with respect to a hit position of the liquid droplet. For this reason, on a liquid droplet to be hit later, a force of two opposing directions acts. As a result, the liquid droplet to be hit later is spread symmetrically from the hit position. Thus, according to the ejection method of the present embodiment, coat unevenness of the liquid material is hardly generated.

Moreover, even though the head 114 has the ejection profile shape as shown in FIG. 30, the present invention can be applied. More specifically, even though the shape is asymmetric with respect to the center of the effective length HL of the head, the present invention can be applied. This is because if the respective overlapping portions G include the sub region SR such that sums of the ejected amount from the respective overlapping portions G are the same, the above-mentioned effect can be obtained.

Further, according to the present embodiment, in the ejection device 100, a plurality of nozzles 118 arranged in a direction (X-axis direction) orthogonal to a direction (Y-axis direction) in which the carriage 103 relatively moves. For this reason, it is possible to allow the liquid material 111 to be simultaneously ejected from the plurality of nozzles 118 onto the portion to be ejected 18L extending in the X-axis direction. As a result, the drive signal generating unit 203 for generating the drive signal DS may be one to the plurality of nozzles 118. Further, since the ejection timings of the plurality of nozzles 118 arranged in one direction are synchronous, it is not required for a circuit construction for delaying the drive signal DS from the drive signal generating unit 203. As a result, there are few factors causing the roundness of the waveform in the drive signal DS, and thus it is possible to apply precise ejection waveforms P to the vibrators 124. Therefore, it is possible to make the ejection of the liquid material 111 from the nozzle 118 more stable.

In addition, according to the present embodiment, in the ejection device 100, the nozzle pitch of the head group 114G in the X-axis direction is a length 1/N times shorter than the nozzle pitch of the head in the X-axis direction. Here, N is the number of heads 114 to be included in the head group 114G. For this reason, the line density of the nozzles of the ejection device 100 in the X-axis direction is higher than the line density of the nozzles of a conventional ink jet device in the X-axis direction. As a result, during a period in which the carriage 103 relatively moves in the Y-axis direction just once, it is possible to form a minuter hit pattern along the X-axis direction.

Second Embodiment

An example in which the present invention is applied to a manufacturing device of a color filter substrate will be described.

The base 10A shown in FIGS. 9(*a*) and 9(*b*) is a substrate which undergoes a process by a manufacturing device 1 (FIG. 10) described below and constitutes the color filter substrate 10. The base 10A has a plurality of portions to be ejected 18R, 18G and 18B which are arranged in a matrix shape.

More specifically, the base 10A comprises a light transmissive supporting substrate 12, black matrices 14 formed on the supporting substrate 12, and banks 16 formed on the black matrix 14. The black matrices 14 are made of a light-shielding material. And then, the black matrices 14 and the banks on the black matrices 14 are positioned to define a plurality of light transmissive portions in a matrix shape, that is, a plurality of pixel regions in a matrix shape, on the supporting substrate 12.

In the pixel regions, concave portions defined by the supporting substrate 12, the black matrices 14 and the banks 16 correspond to portions to be ejected 18R, portions to be ejected 18G and portions to be ejected 18B. The portion to be ejected 18R is a region in which a filter layer 111FR for transmitting only light of a red wavelength band is to be formed, the portion to be ejected 18G is a region in which a filter layer 111FG for transmitting only light of a green wavelength band is to be formed, and the portion to be ejected 18B is a region in which a filter layer 111FB for transmitting only light of a blue wavelength band is to be formed.

Figure 9A:
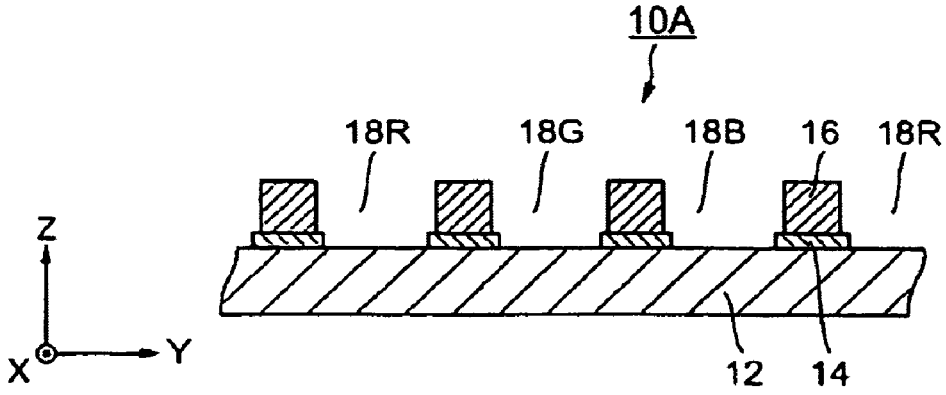
FIGS. 9(*a*) and 9(*b*) are schematic views showing a base of a second embodiment.
Figure 9B:
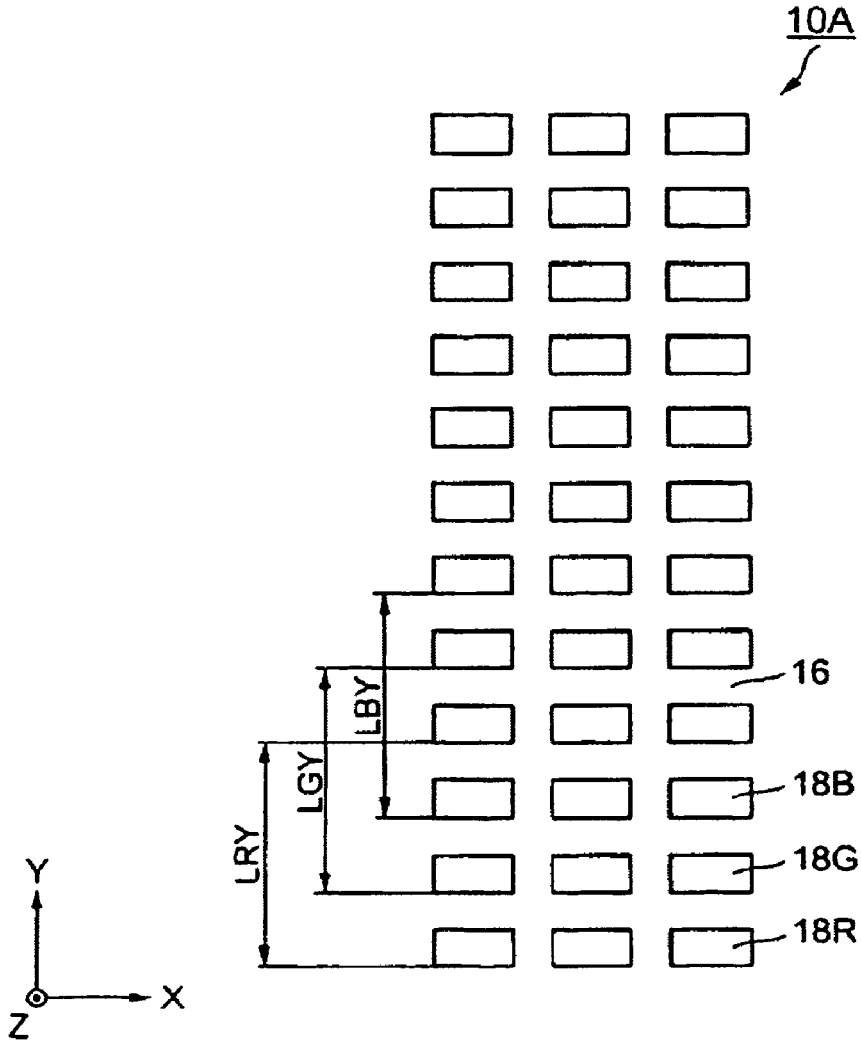

The base 10A shown in FIG. 9(*b*) is positioned on a virtual plane parallel to both the X-axis direction and the Y-axis direction. And then, a row direction and a column direction of a matrix to be formed by the plurality of portions to be ejected 18R, 18G and 18B are parallel to the X-axis direction and the Y-axis direction respectively. In the base 10A, the portion to be ejected 18R, the portion to be ejected 18G and the portion to be ejected 18B are arranged periodically in the Y-axis direction in that order. Meanwhile, the portions to be ejected 18R are constantly arranged in a row in the X-axis direction at a predetermined interval together, the portions to be ejected 18G are constantly arranged in a row in the X-axis direction at a predetermined interval together, and the portions to be ejected 18B are constantly arranged in a row in the X-axis direction at a predetermined interval together. Moreover, the X-axis direction and the Y-axis direction are orthogonal to each other.

A constant interval LRY along the Y-axis direction among the portions to be ejected 18R, that is, a pitch, is approximately 560 $\mu$m. The interval is the same as an interval LGY along the Y-axis direction between the portions to be ejected 18G and an interval LBY along the Y-axis direction between the portions to be ejected 18B. Further, a planar shape of the portion to be ejected 18R is a rectangular defined longer sides and shorter sides. More specifically, a length of the portion to be ejected 18R in the Y-axis direction is approximately 100 $\mu$m, and a length thereof in the X-axis direction is approximately 300 $\mu$m. The portions to be ejected 18G and 18B also have the same shape and size. The interval among the portions to be ejected 18R and the size of the portion to be ejected 18R correspond to an interval among pixel regions and a size of the pixel region which correspond to the same color in a high vision television of about 40-inch size.

Figure 10:
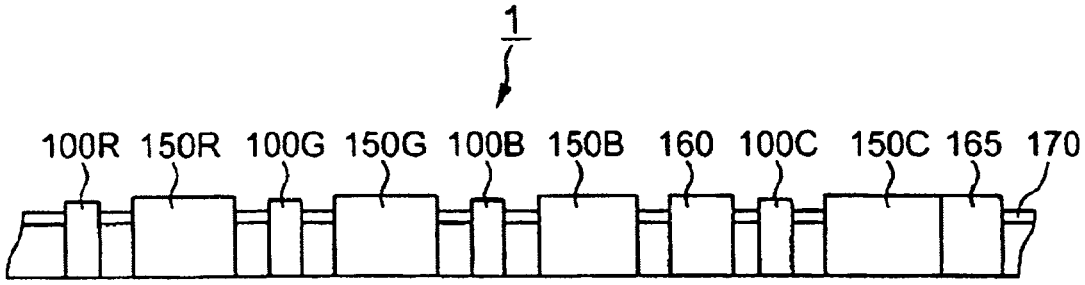
FIG. 10 is a schematic view showing a manufacturing device according to the second embodiment.

A manufacturing device 1 shown in FIG. 10 is a device for ejecting a corresponding color filter material onto each of the portions to be ejected 18R, 18G and 18B of the base 10A in FIG. 9. More specifically, the manufacturing device 1 comprises an ejection device 100R for coating a color filter material 111R to all the portions to be ejected 18R, a drying device 150R for drying the color filter material 111R on the portions to be ejected 18R, an ejection device 100G for coating a color filter material 111G to all the portions to be ejected 18G, a drying device 150G for drying the color filter material 111G on the portions to be ejected 18G, an ejection device 100B for coating a color filter material 111B to all the portions to be ejected 18B, and a drying device 150B for drying the color filter material 111B on the portions to be ejected 18B. The manufacturing device 1 further comprises an oven 160 for heating the color filter materials 111R, 111G and 111B again (postbaking), an ejection device 100C for providing a protective film 20 on the postbaked color filter materials 111R, 111G and 111B, a drying device 150C for drying the protective film 20, and a hardening device 165 for heating again and hardening the dried protective film 20. In addition, the manufacturing device 1 also comprises a transferring device 170 for transferring the base 10A in an order of the ejection device 100R, the drying device 150R, the ejection device 100G, the drying device 150G, the ejection device 100B, the drying device 150B, the ejection device 100C, the drying device 150C, and the hardening device 165.

Figure 11:
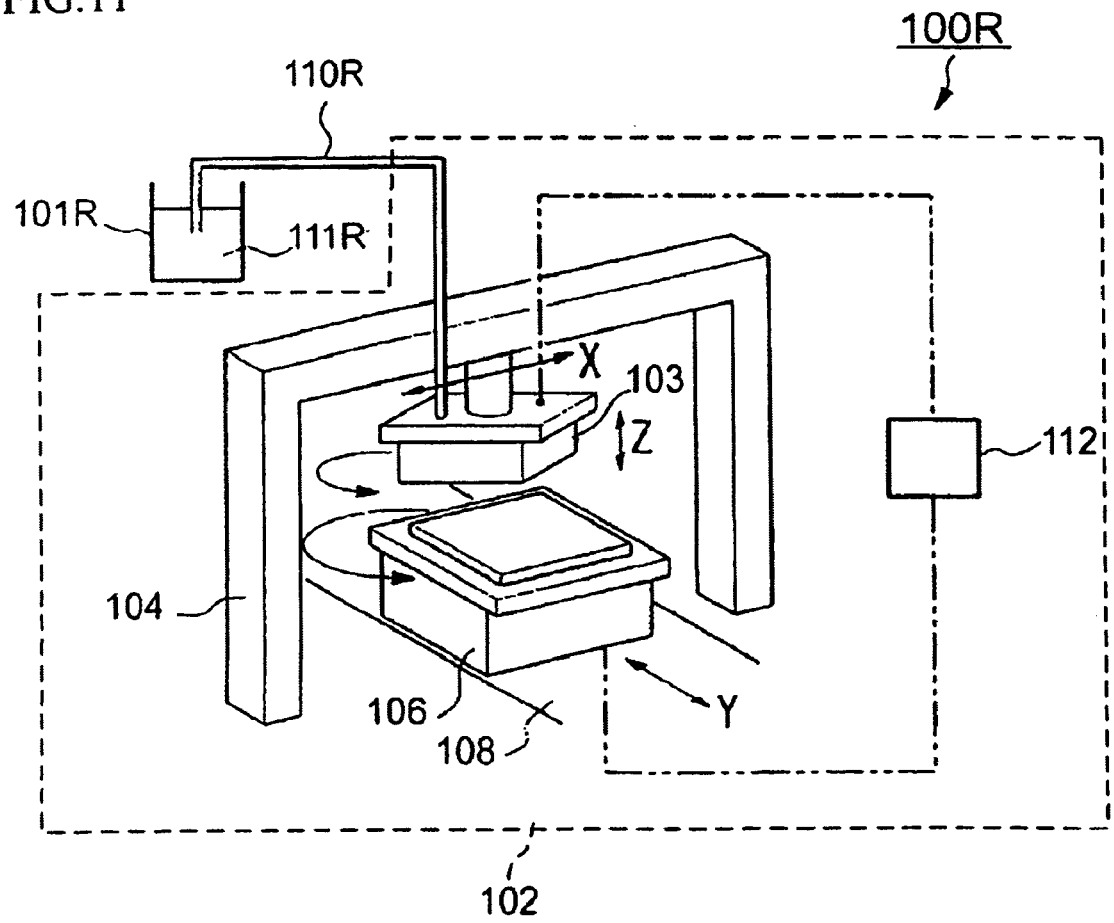
FIG. 11 is a schematic view showing an ejection device according to the second embodiment.

As shown in FIG. 11, a construction of the ejection device 100R is basically the same as the construction of the ejection device 100 in the first embodiment. However, the construction of the ejection device 100R is different from the construction of the ejection device 100 in that the ejection device 100R comprises a tank 101R and a tube 110R for a liquid color filter material, instead of the tank 101 and the tube 110. Moreover, the same reference numerals are used for the same element as those of the ejection device 100 among elements of the ejection device 100R, and the descriptions thereon will be omitted.

The constructions of the ejection device 100G, the ejection device 100B and the ejection device 100C are basically the same as the construction of the ejection device 100R. However, the construction of the ejection device 100G is different from the construction of the ejection device 100R in that the ejection device 100G comprises a tank and a tube for a color filter material 111G, instead of the tank 101R and the tube 110R in the ejection device 100R. Similarly, the construction of the ejection device 100B is different from the construction of the ejection device 100R in that the ejection device 100B comprises a tank and a tube for a color filter material 111B, instead of the tank 101R and the tube 110R. In addition, the construction of the ejection device 100C is different from the construction of the ejection device 100R in that the ejection device 100C comprises a tank and a tube for a protective film material, instead of the tank 101R and the tube 110R. Moreover, in the present embodiment, the liquid color filter materials 111R, 11G and 111B is an example of liquid materials of the present invention.

Next, an operation of the ejection device 100R will be described. The ejection device 100R ejects the same material onto the plurality of portions to be ejected 18R arranged in a matrix shape on the base 10A. Moreover, like third to fifth embodiments described below, the base 10A may be substituted with a substrate for an electroluminescent display device, a rear substrate for a plasma display device or a substrate for an image display device provided with an electron emission element.

Figure 12:
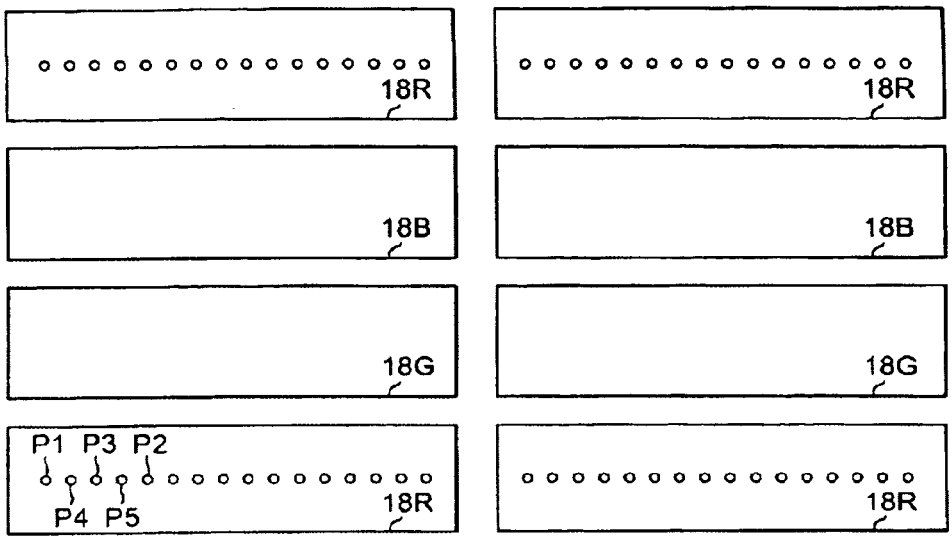
FIG. 12 is a schematic view showing an ejection method according to the second embodiment.
Figure 12:
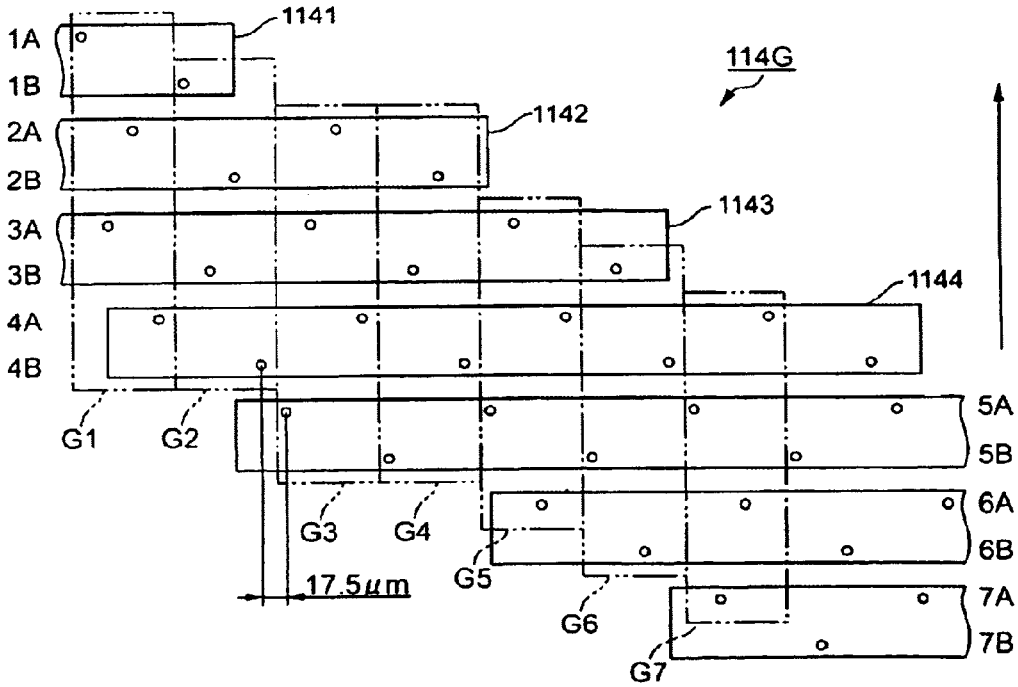
Figure 13A:
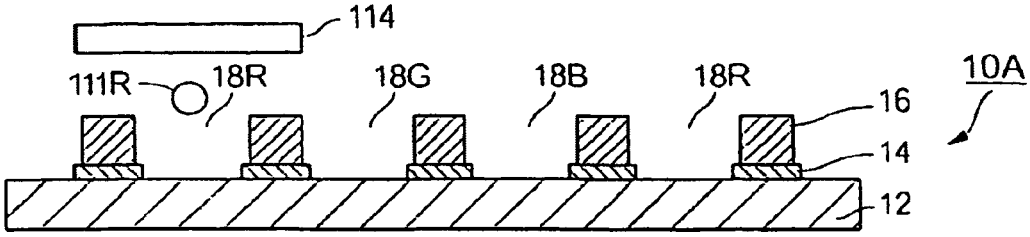
FIGS. 13(*a*)–(*d*) are schematic views showing a manufacturing method according to the second embodiment.
Figure 13B:
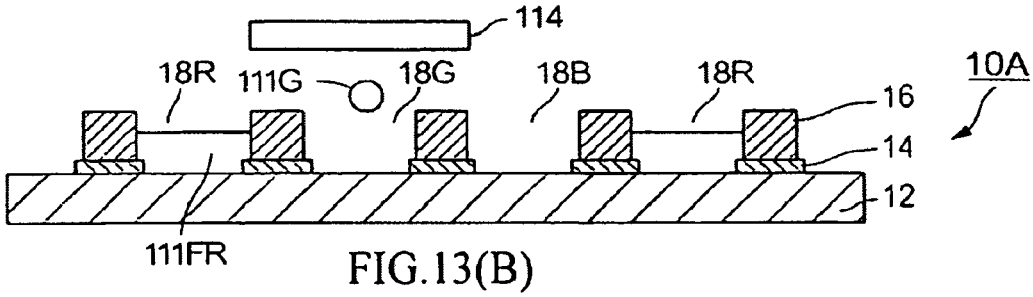
Figure 13C:
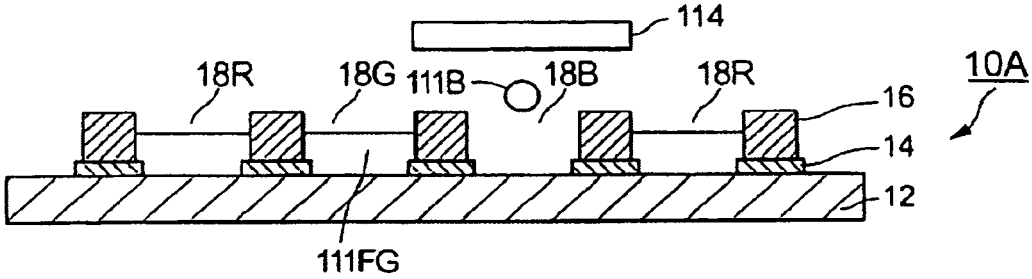
Figure 13D:
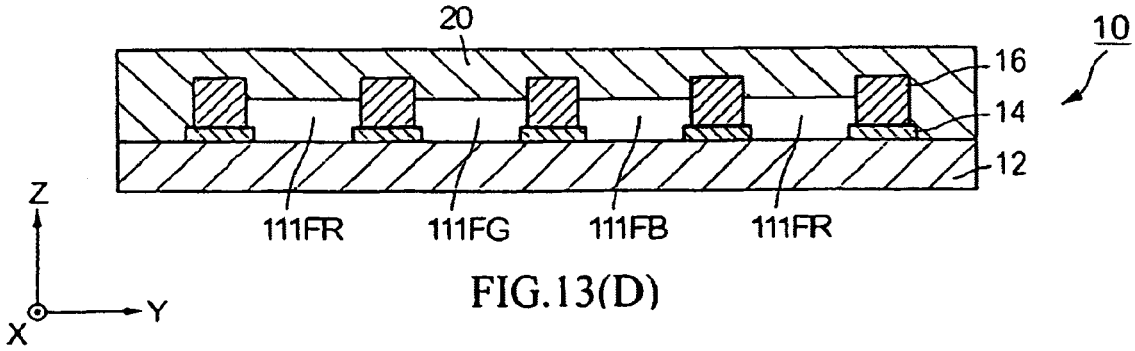

The base 10A shown in FIG. 12 is held by the stage 106 such that the longer side direction and the shorter side direction of the portion to be ejected 18R are aligned with the X-axis direction and the Y-axis direction respectively.

First, prior to a start of a first scan period, the control unit 112 relatively moves the carriage 103, that is, the head group 114G, in the X-axis direction with respect to the base 10A such that X coordinates of some nozzles 118 being included in the overlapping portions G (in FIG. 12, G1, G2 are fallen within an X coordinate range of the portion to be ejected 18R. The X coordinate range of the portion to be ejected 18R is a ranged to be determined by X coordinates of both ends of the longer side of the portion to be ejected 18R. In the present embodiment, the length of the longer side of the portion to be ejected 18R is about 300 $\mu$m, and the nozzle pitch HXP of the head group 114G in the X-axis direction is 17.5 $\mu$m. For this reason, 16 or 17 nozzles 118 in the head group 114G are fallen within the X coordinate range of one portion to be ejected 18R. From the nozzles 118 other than the X coordinate range, the color filter material 111R is not ejected within the first scan period.

Figure 29:
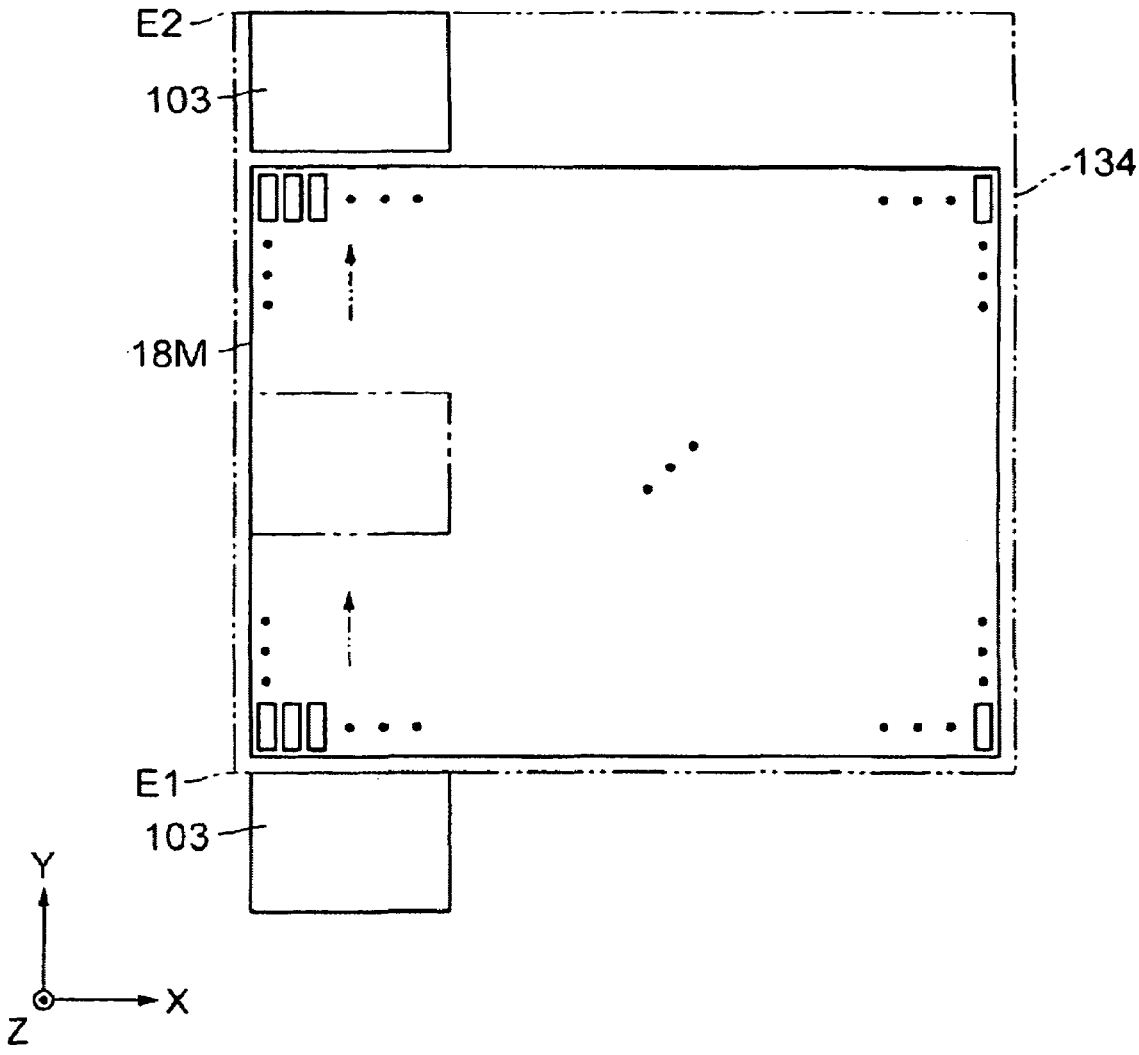
FIG. 29 is a schematic view showing a scan range.

By the way, in the present embodiment, 'a scan period means a period in which one sideline of the carriage 103 relatively moves from one end E1 (or the other end E2) of the scan range 134 to the other end E2 thereof (or one end E1) along the Y-axis direction, as shown in FIG. 29. 'The scan range 134' means a range in which the carriage 103 relatively moves so as to coat the material onto all the portions to be ejected 18R on the base 10A. All the portions to be ejected 18R are covered with the scan range 134. Moreover, in some cases, the term 'scan range' may mean a range in which one nozzle 118 relatively moves, a range in which one nozzle string 116 relatively moves or a range in which one head 114 relatively moves.

The control unit 112 determines the speed of the relative move of the carriage 103 such that one nozzle 118 and the portions to be ejected 18R arranged in the Y-axis direction overlaps every time interval of integer times larger than the ejection period EP (FIG. 7(*b*)). If doing so, other nozzles 118 in the nozzle string including one nozzle 118 also respectively overlap the portions to be ejected 18R every time interval of integer times larger than the ejection period EP. In the present embodiment, the pitch of the portion to be ejected 18R in the Y-axis direction is LRY (FIG. 9(*b*)). Thus, if the speed of the relative move of the carriage 103 with respect to the stage 106 is V, V=LRY (k·P) is satisfied. Here, k is an integer.

If the first scan period starts, the head group 114G starts to move from one end E1 of the scan range 134 in a positive direction of the Y-axis direction (an upper direction of a paper in FIG. 12). If so, the nozzle strings 1A, 1B, 2A, 2B, 3A, 3B, 4A, 4B, 5A, 5B, 6A, 6B, 7A and 7B enter into a region corresponding to the portion to be ejected 18R in that order. Moreover, during the first scan period, the X coordinate of the head group 114G does not change.

In the example shown in FIG. 12, the color filter material 111R is ejected from the nozzles 118 belonging to the overlapping portion G1 onto the first to fourth hit positions from the left of the lower left portion to be ejected 18R. Onto the fifth to eighth hit positions from the left, the color filter material 111R is ejected from the nozzles 118 belonging to the overlapping portion G2. Onto the ninth to twelfth hit positions from the left, the color filter material 111R is ejected from the nozzles 118 belonging to the overlapping portion G3. Onto the thirteenth to sixteenth hit positions from the left, the color filter material 111R is ejected from the nozzles 118 belonging to the overlapping portion G4.

In one portion to be ejected 18R, the liquid droplets of the color filter material 111R are ejected from the plurality of overlapping portions G. An overall volume of the liquid droplets to be ejected from each of the plurality of overlapping portions G, that is, an overall volume of the liquid droplets to be ejected from all the nozzles 118 included in one overlapping portion G is the same. Thus, an inside of each of the portions to be ejected 18R is uniformly covered with the color filter material 111R. Besides, as described in the first embodiment, the nozzles 118 belonging to various sub regions SR are adjacent in the X-axis direction in the head group 114G, such that the difference in the ejected amount depending on the positions of the nozzles 118 is likely to be offset. As a result, the coat unevenness among the portions to be ejected 18R becomes unnoticeable.

In addition, according to the present embodiment, within one scan period, the color filter material 111R having a required volume can be ejected onto one portion to be ejected 18R. This is because the nozzle pitch GXP of the head group 114G in the X-axis direction is approximately ¼ of the nozzle pitch HXP of one head 114 in the X-axis direction, such that, within one scan period, more nozzles 118 overlap one portion to be ejected.

Meanwhile, as shown in FIG. 12, in the first scan period, the leftmost nozzle 118 in the nozzle string 1A, the second nozzle 118 from the right in the nozzle string 2A, the second nozzle 118 from the right in the nozzle string 3A and the second nozzle 118 from the right in the nozzle string 4A does not overlap the portion to be ejected 18R. Therefore, the ejection of the color filter material 111R from these nozzles is not performed.

If the first scan period ends, the control unit 112 starts next scan period while relatively moving the head group 114G in the X-axis direction, such that the color filter material 111 is ejected to the portions to be ejected 18R which are not yet coated.

In the above description, only the process in which the color filter material 111R is coated on the portions to be ejected 18R is described. Hereinafter, a series of processes until the color filter substrate 10 is obtained by the manufacturing device 1 will be described.

To begin with, the base 10A shown in FIG. 9 is prepared according to a procedure described below. First, a metallic thin film is formed on the supporting substrate 12 by means of a sputtering method or a vapor deposition method. And then, a lattice-shaped black matrix 14 is formed from the metallic thin film by means of a photolithography process. As a material of the black matrix 14, metallic chromium or chromium oxide may be included. Moreover, the supporting substrate 12 is a substrate having light transmittance to visible light, for example, a glass substrate. Subsequently, in order to cover the supporting substrate 12 and the black matrix 14, a resist layer made of a negative photosensitive resin composition is coated. And then, a mask film formed in a matrix pattern shape is adhered closely onto the resist layer, and the resist layer is exposed. Subsequently, by removing unexposed portions of the resist layer with an etching process, the banks 16 are obtained. With the above processes, the base 10A is obtained.

Moreover, instead of the banks 16, banks made of resin black may be used. In this case, it is not required for the metallic thin film (the black matrix 14). Thus, the bank layer is made of only one layer.

Next, by means of an oxygen plasma process under atmospheric pressure, the base 10A is hydrophilized. By this process, in the respective concave portions defined by the supporting substrate 12, the black matrices 14 and the banks 16, a surface of the supporting substrate 12, surfaces of the black matrices 14 and surfaces of the banks 16 exhibit hydrophilic property. And then, with respect to the base 10A, a plasma process in which $CF_4$ is used as a processing gas is performed. By the plasma process using $CF_4$, the surface of the bank 16 in each concave portion is fluorinated (liquid repellency process), such that the surfaces of the banks 16 exhibit liquid repellency. Moreover, the surface of the supporting substrate 12 and the surfaces of the black matrix 14 having the hydrophilic property previously provided lose the hydrophilic property a little by means of the plasma process using $CF_4$, but these surfaces still maintain the hydrophilic property. In such a manner, a predetermined surface treatment on the surfaces of the concave portions defined by the supporting substrate 12, the black matrices 14 and the banks 16 are performed, such that the surfaces of the concave portions become the portions to be ejected 18R, 18G and 18B.

Moreover, according to a material of the supporting substrate 12, a material of the black matrix 14 and a material of the bank 16, the surfaces having desired hydrophilic property and liquid repellency can be obtained, even though the above-mentioned treatment is not performed. In that case, even though the above-mentioned treatment is not performed, the surfaces of the concave portions defined by the supporting substrate 12, the black matrices 14 and the banks 16 become the portions to be ejected 18R, 18G and 18B.

The base 10A on which the portions to be ejected 18R, 18G and 18B are formed is transferred to the stage 106 of the ejection device 100R by means of the transferring device 170. Further, as shown in FIG. 13(*a*), the ejection device 100R ejects the color filter material 111R from the heads 114 such that a layer of the color filter material 111R is formed in all the portions to be ejected 18R. More specifically, the ejection device 100R coats the color filter material 111R to the portions to be ejected 18R by the ejection method described with reference to FIG. 12. If the layer of the color filter material 111R is formed in all the portions to be ejected 18R of the base 10A, the transferring device 170 locates the base 10A in the drying device 150R. And then, the color filter material 111R on the portions to be ejected 18R is completely dried, such that the filter layer 111FR is formed on the portions to be ejected 18R.

Next, the transferring device 170 locates the base 10A in the stage 106 of the ejection device 100G. And then, as shown in FIG. 13(*b*), the ejection device 100G ejects the color filter material 111G from the heads 114 such that a layer of the color filter material 111G is formed in the portions to be ejected 18G. More specifically, the ejection device 100G coats the color filter material 111G to the portions to be ejected 18G by the ejection method described with reference to FIG. 12. If the layer of the color filter material 111G is formed in all the portions 18G to be ejected of the base 10A, the transferring device 170 locates the base 10A in the drying device 150G. And then, the color filter material 11G on the portions to be ejected 18G is completely dried, such that the filter layer 111FG is formed on the portions to be ejected 18G.

Next, the transferring device 170 locates the base 10A in the stage 106 of the ejection device 100B. And then, as shown in FIG. 13(*c*), the ejection device 100B ejects the color filter material 111B from the heads 114 such that a layer of the color filter material 111B is formed in the portions to be ejected 18B. More specifically, the ejection device 100B coats the color filter material 111B to the portions to be ejected 18B by the ejection method described with reference to FIG. 12. If the layer of the color filter material 111B is formed in all the portions to be ejected 18B of the base 10A, the transferring device 170 locates the base 10A in the drying device 150B. And then, the color filter material 111B on the portions to be ejected 18B is completely dried, such that the filter layer 111FB is formed on the portions to be ejected 18B.

Next, the transferring device 170 locates the base 10A in the oven 160. Subsequently, the oven 160 heats the filter layers 111FR, 111FG and 111FB again (postbaking).

Next, the transferring device 170 locates the base 10A in the stage 106 of the ejection device 100C. And then, the ejection device 100C ejects a liquid protective film material such that the protective film 20 is formed to cover the filter layers 111FR, 111FG and 111FB and the bank 16. After the protective film 20 covering the filter layers 111FR, 111FG and 111FB and the bank 16 is formed, the transferring device 170 locates the base 10A in the drying device 150C. And then, after the drying device 150C dries completely the protective film 20, the hardening device 165 heats and hardens completely the protective film 20, such that the base 10A becomes the color filter substrate 10.

According to the present embodiment, in the respective ejection devices 100R, 100G and 100B, the nozzle pitch of the head group 114G in the X-axis direction is a length 1/N times shorter than the nozzle pitch of the head 114 in the X-axis direction. Here, N is the number of the heads 114 included in the head group 114G. For this reason, the line density of the nozzles of the ejection devices 100R, 100G and 100B in the X-axis direction is higher than the line density of the nozzles of a conventional ink jet device in the X-axis direction. Therefore, the manufacturing device 1 can coat the color filter material to the portions to be ejected having various sizes only by changing ejection data. In addition, the manufacturing device 1 can manufacture the color filter substrate having various pitches only by changing ejection data.

Further, according to the present embodiment, the liquid droplets of the color filter materials 111R, 111G and 111B are ejected from the plurality of overlapping portions G onto the portions to be ejected 18R, 18G and 18B. An overall volume of the liquid droplets to be ejected from each of the overlapping portions G, that is, an overall volume of the liquid droplets to be ejected from all the nozzles 118 included in one overlapping portion G is the same. Thus, an inside of each of the portions to be ejected 18R, 18G and 18B is uniformly covered with the color filter material 111R, 111G and 111B. Besides, as described in the first embodiment, the nozzles 118 belonging to various sub regions SR are adjacent in the X-axis direction in the head group 114G, such that the difference in the ejected amount depending on the positions of the nozzles 118 is likely to be offset. As a result, the coat unevenness among the portions to be ejected 18R, the coat unevenness among the portions to be ejected 18G, and the coat unevenness among the portions to be ejected 18B become unnoticeable.

In addition, according to the present embodiment, the liquid droplets of the color filter materials 111R, 111G and 111B may hit onto a halfway between two positions already covered with the liquid droplets. Thus, a liquid droplet to be hit later contacts two liquid droplets hit in advance onto two positions which are symmetric with respect to a hit position of the liquid droplet. For this reason, on a liquid droplet to be hit later, a force of two opposing directions acts. As a result, the liquid droplet to be hit later is spread symmetrically from the hit position thereof. Thus, according to the ejection method of the present embodiment, coat unevenness of the color filter materials 111R, 111G and 111B is hardly generated.

Third Embodiment

Next, an example in which the present invention is applied to a manufacturing device of an electroluminescent display device will be described.

The base 30A shown in FIGS. 14(*a*) and 14(*b*) is a substrate which becomes an electroluminescent display device 30 by means of a process with a manufacturing device 2 (FIG. 15) described below. The base 30A has a plurality of portions to be ejected 38R, 38G and 38B arranged in a matrix shape.

More specifically, the base 30A comprises a supporting substrate 32, a circuit element layer 34 formed on the supporting substrate 32, a plurality of pixel electrodes 36 formed on the circuit element layer 34, and banks 40 formed between the plurality of pixel electrodes 36. The supporting substrate is a substrate having light transmittance to visible light, for example, a glass substrate. Each of the plurality of pixel electrodes 36 is an electrode having light transmittance to visible light, for example, an ITO (Indium-Tin Oxide) electrode. Further, the plurality of pixel electrodes 36 is arranged in a matrix shape on the circuit element layer 34, and each pixel electrode defines a pixel region. And then, the banks 40 have a lattice shape, and surround respectively the plurality of pixel electrode 36. Further, each bank 40 is comprised of an inorganic bank 40A formed on the circuit element layer 34 and an organic bank 40B disposed on the inorganic bank 40A.

The circuit element layer 34 is a layer comprising a plurality of scanning electrodes extending in a predetermined direction in the supporting substrate 32, an insulating film 42 formed to cover the plurality of scanning electrodes, a plurality of signal electrodes disposed on the insulating film 42 and extending a direction orthogonal to the direction in which the plurality of scanning electrodes extends, a plurality of switching elements 44 disposed at intersections the scanning electrodes and the signal electrodes, and an interlayer insulating film 45 of polyimide or the like formed to cover the plurality of switching elements 44. The gate electrode 44G and the source electrode 44S of each of the switching elements 44 are electrically connected to a corresponding scanning electrode and a corresponding signal electrode respectively. On the interlayer insulating film 45, the plurality of pixel electrodes 36 is disposed. In the interlayer insulating film 45, a through hole 44V is provided at a part corresponding to the drain electrode 44D of each of the switching elements 44, and an electrical connection between the switching element 44 and the corresponding pixel electrode 36 is formed via the through hole 44V. Further, each switching element 44 is located at a position corresponding to the bank 40. That is, as viewed from a direction vertical to a paper of FIG. 13(*b*), each of the plurality of switching element 44 is located to be covered with the bank 40.

The concave portions (a portion of the pixel region) defined by the pixel electrodes 36 and the banks 40 of the base 30A correspond to the portions to be ejected 38R, 38G and 38B. The portion to be ejected 38R is a region in which a light-emitting layer 211FR emitting light of a red wavelength band is to be formed, the portion to be ejected 38G is a region in which a light-emitting layer 211FG emitting light of a green wavelength band is to be formed, and the portion to be ejected 38B is a region in which a light-emitting layer 211FB emitting light of a blue wavelength band is to be formed.

Figure 14A:
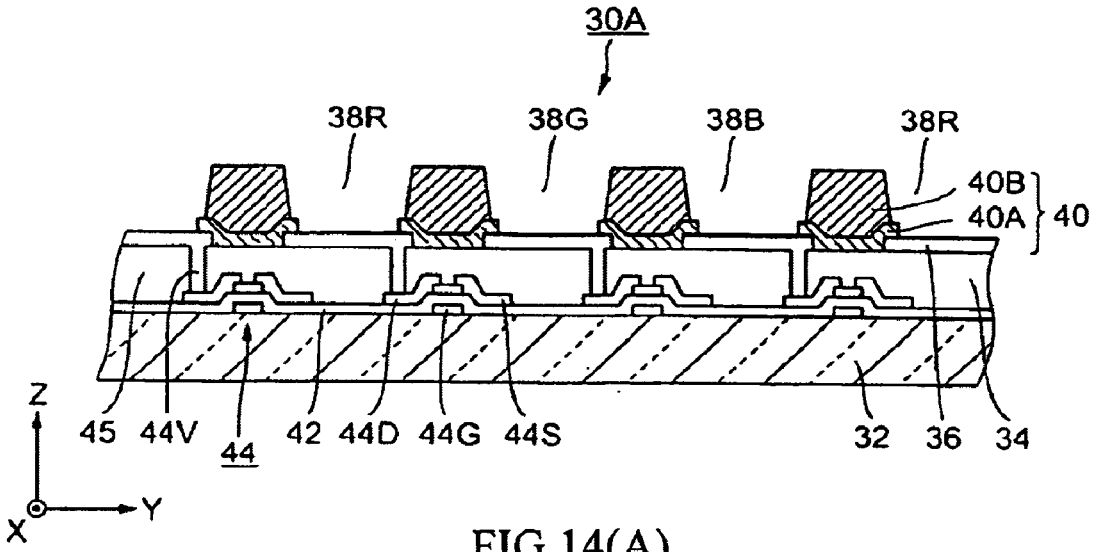
FIGS. 14(*a*) and 14(*b*) are schematic views showing a base according to a third embodiment.
Figure 14B:
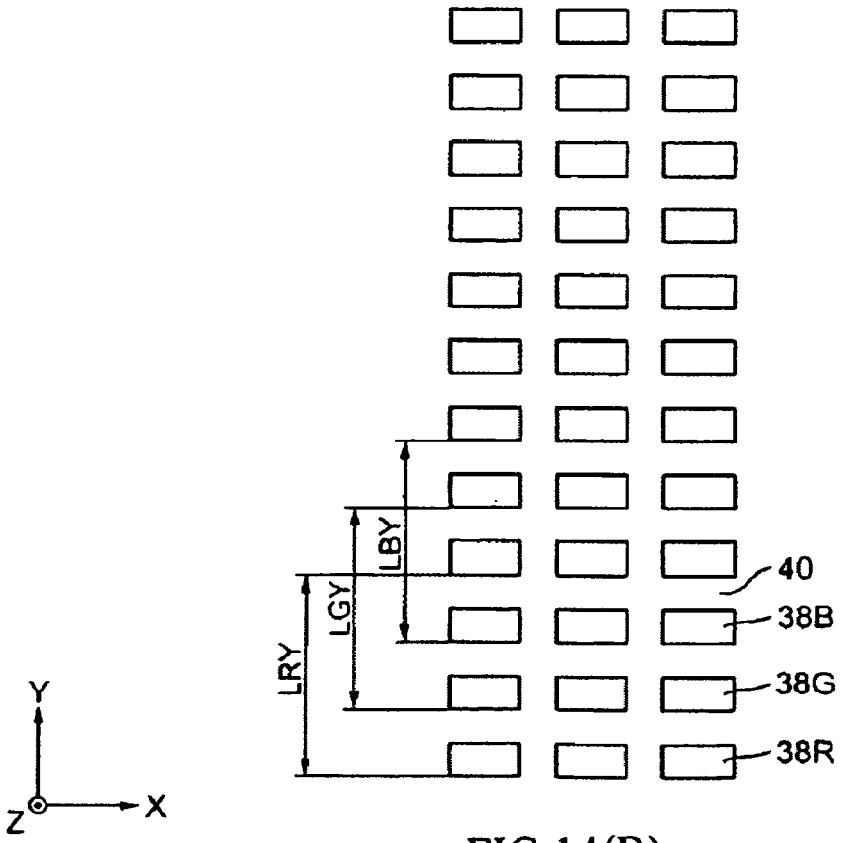

The base 30A shown in FIG. 14(*b*) is located on a virtual plane parallel to both the X-axis direction and the Y-axis direction. And then, a row direction and a column direction of a matrix to be formed by the plurality of portions to be ejected 38R, 38G and 38B are parallel to the X-axis direction and the Y-axis direction respectively. In the base 30A, the portion to be ejected 38R, the portion to be ejected 38G and the portion to be ejected 38B are arranged periodically in the Y-axis direction in that order. Meanwhile, the portions to be ejected 38R are constantly arranged in a row in the X-axis direction at a predetermined interval together, the portions to be ejected 38G are constantly arranged in a row in the X-axis direction at a predetermined interval together, and the portions 38B to be ejected are constantly arranged in a row in the X-axis direction at a predetermined interval together. Moreover, the X-axis direction and the Y-axis direction are orthogonal to each other.

A constant interval LRY along the Y-axis direction among the portions to be ejected 38R, that is, a pitch, is approximately 560 $\mu$m. The interval is the same as an interval LGY along the Y-axis direction between the portions to be ejected 38G and an interval LBY along the Y-axis direction between the portions to be ejected 38B. Further, a planar shape of the portion to be ejected 38R is a rectangular defined longer sides and shorter sides. More specifically, a length of the portion to be ejected 38R in the Y-axis direction is approximately 100 $\mu$m, and a length thereof in the X-axis direction is approximately 300 $\mu$m. The portions to be ejected 38G and 38B also have the same shape and size. The interval among the portions to be ejected 38R and the size of the portion to be ejected 38R correspond to an interval among pixel regions and a size of the pixel region which correspond to the same color in a high vision television of about 40-inch size.

Figure 15:
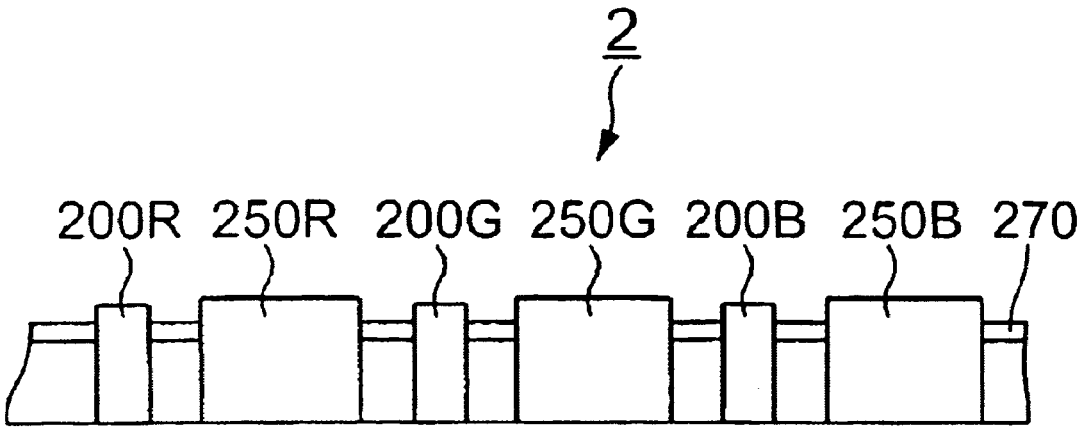
FIG. 15 is a schematic view showing a manufacturing device according the third embodiment.

A manufacturing device 2 shown in FIG. 15 is a device for ejecting a corresponding light-emitting material onto each of the portions to be ejected 38R, 38G and 38B of the base 30A in FIG. 14. The manufacturing device 2 comprises an ejection device 200R for coating a light-emitting material 211R to all the portions to be ejected 38R, a drying device 250R for drying the light-emitting material 211R on the portions to be ejected 38R, an ejection device 200G for coating a light-emitting material 211G to all the portions to be ejected 38G, a drying device 250G for drying the light-emitting material 211G on the portions to be ejected 38G, an ejection device 200B for coating a light-emitting material 211B to all the portions to be ejected 38B, and a drying device 250B for drying the light-emitting material 211B on the portions to be ejected 38B. In addition, the manufacturing device 2 also comprises a transferring device 270 for transferring the base 30A in an order of the ejection device 200R, the drying device 250R, the ejection device 200G, the drying device 250G, the ejection device 200B, and the drying device 250B.

Figure 16:
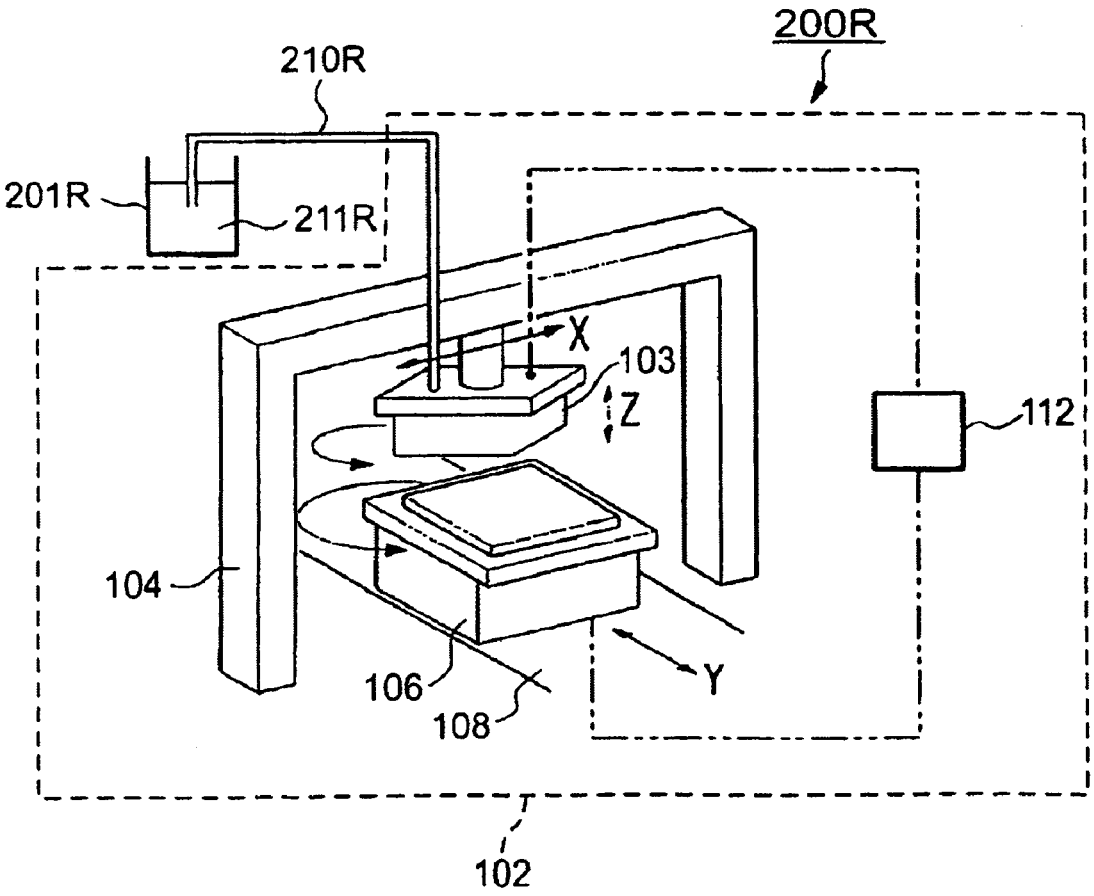
FIG. 16 is a schematic view showing an ejection device according to the third embodiment.
Figure 17A:
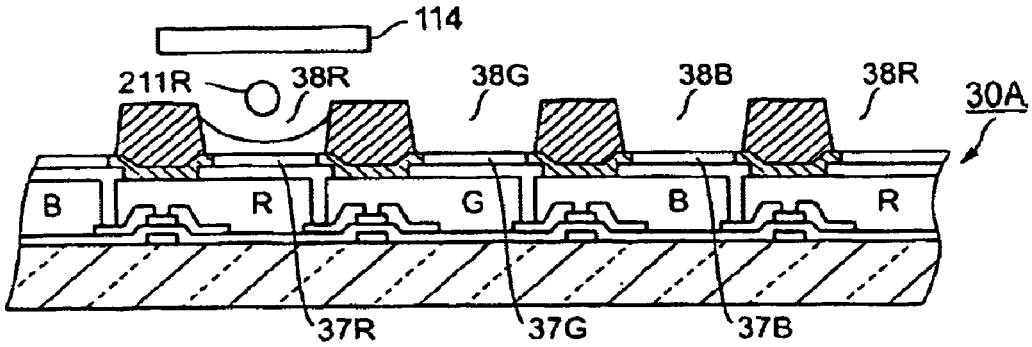
FIGS. 17(*a*)–(*d*) are schematic views showing a manufacturing method according to the third embodiment.
Figure 17B:
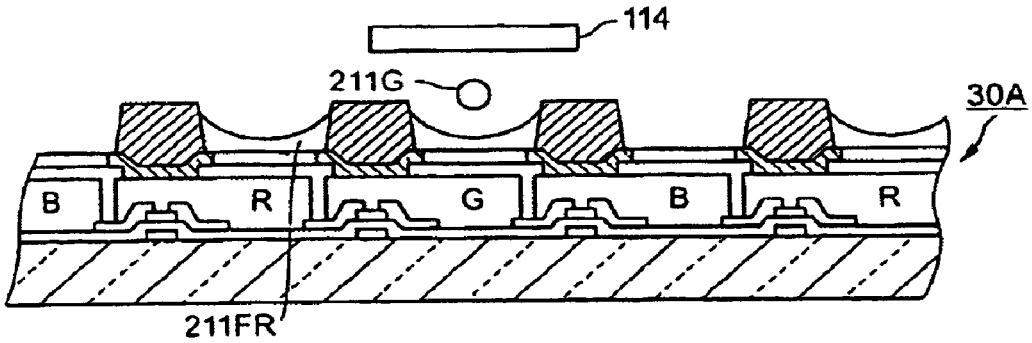
Figure 17C:
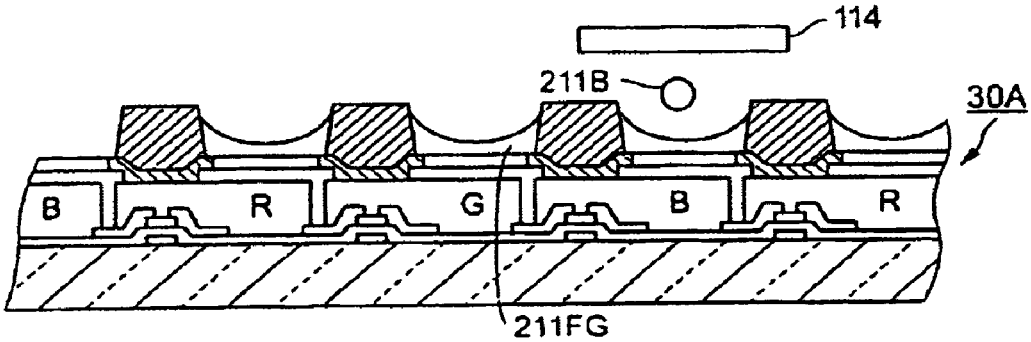
Figure 17D:
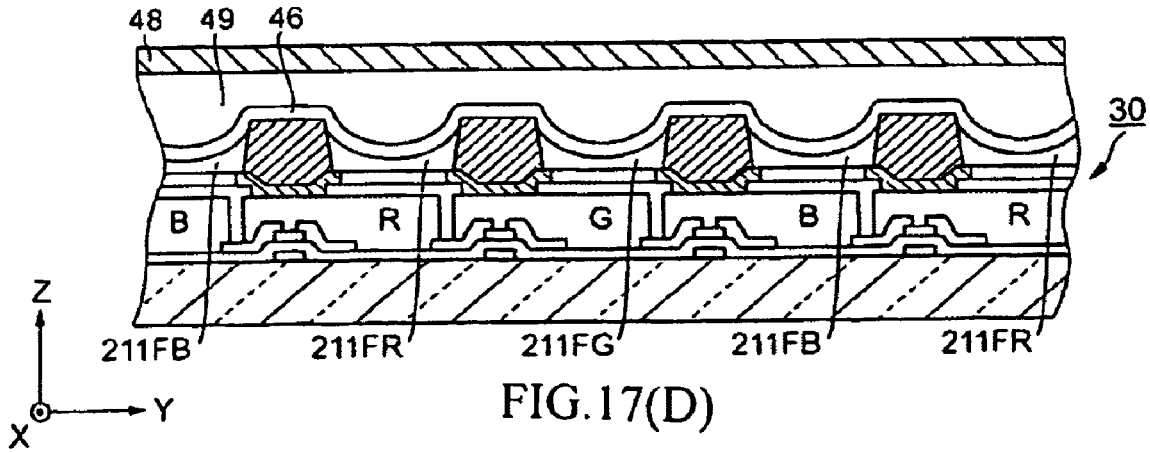

The ejection device 200R shown in FIG. 16 comprises a tank 201R for storing a liquid light-emitting material 211R, a tube 210R, and an ejection scan unit 102 to which the light-emitting material 211R is supplied from the tank 201R via the tube 210R. Since the construction of the ejection scan unit 102 is the same as the construction of the ejection scan unit 102 of the first embodiment (FIG. 1), the same reference numerals are used for the same element, and the descriptions thereon will be omitted. The constructions of the ejection device 200G and the ejection device 200B are basically the same as the construction of the ejection device 200R. However, the construction of the ejection device 200G is different from the construction of the ejection device 200R in that the ejection device 200G comprises a tank and a tube for a light-emitting material 211G, instead of the tank 201R and the tube 210R. Similarly, the construction of the ejection device 200B is different from the construction of the ejection device 200R in that the ejection device 200B comprises a tank and a tube for a light-emitting material 211B, instead of the tank 201R and the tube 210R. Moreover, in the present embodiment, the liquid light-emitting materials 211R, 211G and 211B is an example of liquid materials of the present invention.

A manufacturing method of an electroluminescent display device 30 using the manufacturing device 2 will be described. To begin with, the base 30A in FIG. 14 is manufactured using known film-forming and patterning techniques.

Next, by means of an oxygen plasma process under atmospheric pressure, the base 30A is hydrophilized. By this process, in the respective concave portions (a portion of the pixel region) defined by the pixel electrodes 36 and the banks 40, surfaces of the pixel electrodes 36, surfaces of the inorganic banks 40A and surfaces of the organic banks 40B exhibit hydrophilic property. And then, with respect to the base 30A, a plasma process in which $CF_4$ is used as a processing gas is performed. By the plasma process using $CF_4$, the surface of the organic bank 40B in each concave portion is fluorinated (liquid repellency process), such that the surface of the organic bank 40B exhibit liquid repellency. Moreover, the surfaces of the pixel electrodes 36 and the surfaces of the inorganic banks 40A with the hydrophilic property previously provided lose the hydrophilic property a little by means of the plasma process using $CF_4$, but these surfaces still maintain the hydrophilic property. In such a manner, a predetermined surface treatment on the surfaces of the concave portions defined by the pixel electrodes 36 and the banks 40 are performed, such that the surfaces of the concave portions become the portions to be ejected 38R, 38G and 38B.

Moreover, according to a material of the pixel electrode 36, a material of the inorganic bank 40A and a material of the organic bank 40B, the surfaces having desired hydrophilic property and liquid repellency can be obtained, even though the above-mentioned treatment is not performed. In that case, even though the above-mentioned treatment is not performed, the surfaces of the concave portions defined by the pixel electrodes 36 and the banks 40 become the portions to be ejected 38R, 38G and 38B.

Here, on each of the plurality of pixel electrodes 36 with the surface treatment performed, hole transporting layers 37R, 37G and 37B may be formed. If the hole transporting layers 37R, 37G and 37B are respectively positioned between the pixel electrodes 36 and the respective light-emitting layers 211FR, 211FG and 211FB, light emission efficiency of the electroluminescent display device becomes high. In the case in which the hole transporting layers are provided on the respective pixel electrodes 36, the concave portions defined by the hole transporting layers and the banks 40 correspond to the portions to be ejected 38R, 38G and 38B.

Moreover, the hole transporting layers 37R, 37G and 37B may be formed by means of an ink jet method. In this case, a solution containing a material for forming the hole transporting layers 37R, 37G and 37B is coated to every pixel region at a predetermined amount and dried, such that the hole transporting layers can be formed.

The base 30A on which the portions to be ejected 38R, 38G and 38B are formed is transferred to the stage 106 of the ejection device 200R by means of the transferring device 270. Further, as shown in FIG. 17(*a*), the ejection device 200R ejects the light-emitting material 211R from the heads 114 such that a layer of the light-emitting material 211R is formed in all the portions to be ejected 38R. More specifically, the ejection device 200R coats the light-emitting material 211R to the portions to be ejected 38R by the ejection method described with reference to FIG. 12. If the layer of the light-emitting material 211R is formed in all the portions to be ejected 38R of the base 30A, the transferring device 270 locates the base 30A in the drying device 250R. And then, the light-emitting material 211R on the portions to be ejected 38R is completely dried, such that the light-emitting layer 211FR is formed on the portions to be ejected 38R.

Next, the transferring device 270 locates the base 30A in the stage 106 of the ejection device 200G. And then, as shown in FIG. 17(*b*), the ejection device 200G ejects the light-emitting material 211G from the heads 114 such that a layer of the light-emitting material 211G is formed in all the portions to be ejected 38G. More specifically, the ejection device 200G coats the light-emitting material 211G to the portions to be ejected 38G by the ejection method described with reference to FIG. 12. If the layer of the light-emitting material 211G is formed in all the portions to be ejected 38G of the base 30A, the transferring device 270 locates the base 30A in the drying device 250G. And then, the light-emitting material 211G on the portions to be ejected 38G is completely dried, such that the light-emitting layer 211FG is formed on the portions to be ejected 38G.

Next, the transferring device 270 locates the base 30A in the stage 106 of the ejection device 200B. And then, as shown in FIG. 17(*c*), the ejection device 200B ejects the light-emitting material 211B from the heads 114 such that a layer of the light-emitting material 211B are formed in all the portions to be ejected 38B. More specifically, the ejection device 200B coats the light-emitting material 211B to the portions to be ejected 38B by the ejection method described with reference to FIG. 12. If the layer of the light-emitting material 211B is formed in all the portions to be ejected 38B of the base 30A, the transferring device 270 locates the base 30A in the drying device 250B. And then, the light-emitting material 211B on the portions to be ejected 38B is completely dried, such that the light-emitting layer 211FB is formed on the portions to be ejected 38B.

Next, as shown in FIG. 17(*d*), a counter electrode 46 is provided to cover the light-emitting layers 211FR, 211FG and 211FB and the banks 40. The counter electrode 46 functions as a cathode.

Subsequently, by bonding a sealing substrate 48 and the base 30A in their peripheral portions, the electroluminescent display device 30 shown in FIG. 17(*d*) are obtained. Moreover, between the sealing substrate 48 and the base 30A, inert gas 49 is filled.

In the electroluminescent display device 30, light emitted from the light-emitting layers 211FR, 211FG and 211FB are emitted via the pixel electrode 36, the circuit element layer 34 and the supporting substrate 32. In such a manner, the electroluminescent display device in which light is emitted via the circuit element layer 34 is referred to as a bottom emission type display device.

According to the present embodiment, in the respective ejection devices 200R, 200G and 200B, the nozzle pitch of the head group 114G in the X-axis direction is a length 1/N times shorter than the nozzle pitch of the head 114 in the X-axis direction. Here, N is the number of the heads 114 included in the head group 114G. For this reason, the line density of the nozzles of the ejection devices 200R, 200G and 200B in the X-axis direction is higher than the line density of the nozzles of a conventional ink jet device in the X-axis direction. Therefore, the manufacturing device 2 can coat the light-emitting material to the portions to be ejected having various sizes only by changing ejection data. In addition, the manufacturing device 2 can manufacture the electroluminescent display device having various pitches only by changing ejection data.

Further, according to the present embodiment, the liquid droplets of the light-emitting materials 211R, 211G and 211B are ejected from the plurality of overlapping portions G onto the portions to be ejected 38R, 38G and 38B. An overall volume of the liquid droplets to be ejected from each of the overlapping portions G, that is, an overall volume of the liquid droplets to be ejected from all the nozzles 118 included in one overlapping portion G is the same. Thus, an inside of each of the portions to be ejected 38R, 38G and 38B is uniformly covered with the light-emitting material 211R, 211G and 211B. Besides, as described in the first embodiment, the nozzles 118 belonging to various sub regions SR are adjacent in the X-axis direction in the head group 114G, such that the difference in the ejected amount depending on the positions of the nozzles 118 is likely to be offset. As a result, the coat unevenness among the portions to be ejected 38R, the coat unevenness among the portions to be ejected 38G, and the coat unevenness among the portions to be ejected 38B become unnoticeable.

In addition, according to the present embodiment, the liquid droplets of the light-emitting materials 211R, 211G and 211B may hit onto a halfway between two positions already covered with the liquid droplets. Thus, a liquid droplet to be hit later contacts two liquid droplets hit in advance onto two positions which are symmetric with respect to a hit position of the liquid droplet. For this reason, on a liquid droplet to be hit later, a force of two opposing directions acts. As a result, the liquid droplet to be hit later is spread symmetrically from the hit position thereof. Thus, according to the ejection method of the present embodiment, coat unevenness of the light-emitting materials 211R, 211G and 211B is hardly generated.

Fourth Embodiment

An example in which the present invention is applied to a manufacturing device of a rear substrate of a plasma display device will be described.

The base 50A shown in FIGS. 18(*a*) and 18(*b*) is a substrate which becomes a rear substrate 50B of a plasma display device by means of a process with a manufacturing device 3 (FIG. 19) described below. The base 50A has a plurality of portions to be ejected 58R, 58G and 58B arranged in a matrix shape.

More specifically, the base 50A comprises a supporting substrate 52, a plurality of address electrodes 54 formed in a stripe shape on the supporting substrate 52, a dielectric glass layer 56 formed to cover the address electrodes 54, and a spacer 60 having a lattice shape and defining a plurality of pixel regions. The plurality of pixel regions is disposed in a matrix shape, and rows of a matrix to be formed by the plurality of pixel regions respectively correspond to the respective address electrodes 54. Such a base 50A is formed with a known screen printing technique.

The concave portions defined by the dielectric glass layer 56 and the spacer 60 in the respective pixel regions of the base 50A correspond to the portion to be ejected 58R, the portion to be ejected 58G and the portion to be ejected 58B. The portion to be ejected 58R is a region in which a fluorescent layer 311FR emitting light of a red wavelength band is to be formed, the portion to be ejected 58G is a region in which a fluorescent layer 311FG emitting light of a green wavelength band is to be formed, and the portion to be ejected 58B is a region in which a fluorescent layer 311FB emitting light of a blue wavelength band is to be formed.

Figure 18A:
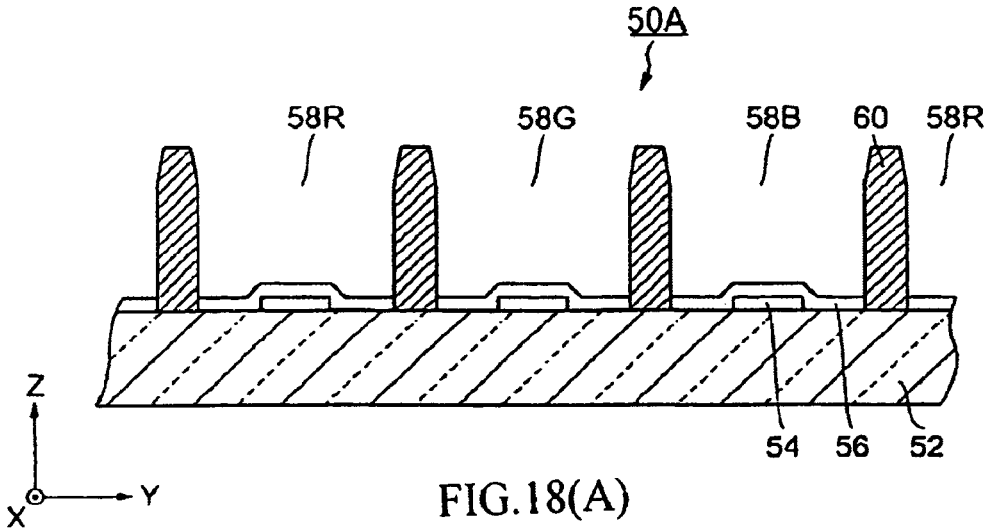
FIGS. 18(*a*) and 18(*b*) are schematic views showing a base according to a fourth embodiment.
Figure 18B:
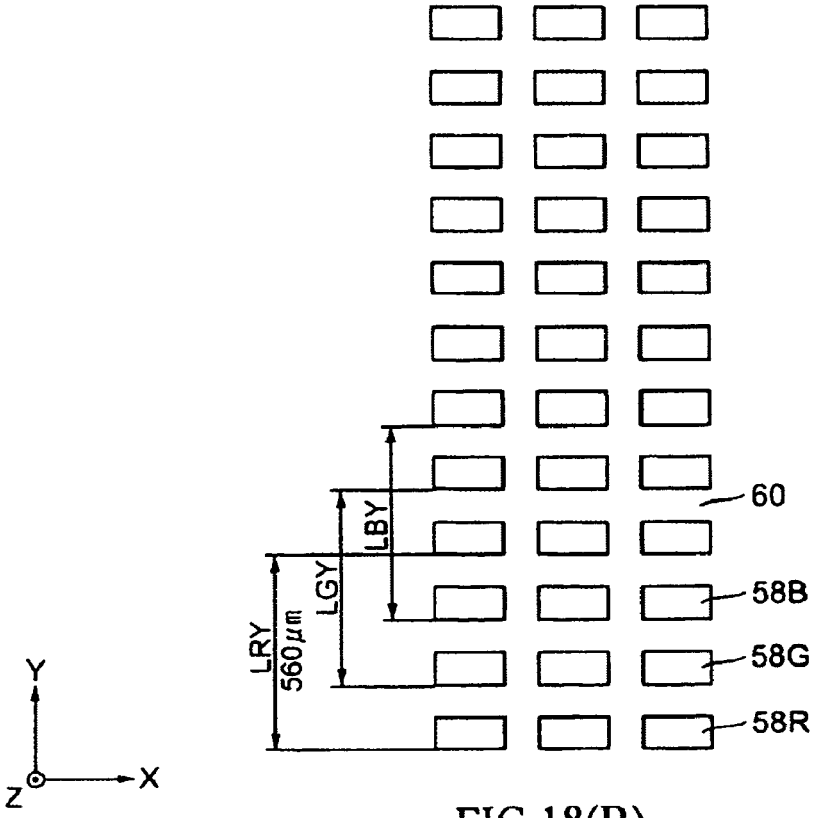

The base 50A shown in FIG. 18(*b*) is located on a virtual plane parallel to both the X-axis direction and the Y-axis direction. And then, a row direction and a column direction of a matrix to be formed by the plurality of portions to be ejected 58R, 58G and 58B are parallel to the X-axis direction and the Y-axis direction respectively. In the base 50A, the portion to be ejected 58R, the portion to be ejected 58G and the portion to be ejected 58B are arranged periodically in the Y-axis direction in that order. Meanwhile, the portions to be ejected 58R are constantly arranged in a row in the X-axis direction at a predetermined interval together, the portions 58G to be ejected are constantly arranged in a row in the X-axis direction at a predetermined interval together, and the portions to be ejected 58B are constantly arranged in a row in the X-axis direction at a predetermined interval together. Moreover, the X-axis direction and the Y-axis direction are orthogonal to each other.

A constant interval LRY along the Y-axis direction among the portions to be ejected 58R, that is, a pitch, is approximately 560 $\mu$M. The interval is the same as an interval LGY along the Y-axis direction between the portions to be ejected 58G and an interval LBY along the Y-axis direction between the portions to be ejected 58B. Further, a planar shape of the portion to be ejected 58R is a rectangular defined longer sides and shorter sides. More specifically, a length of the portion to be ejected 58R in the Y-axis direction is approximately 100 $\mu$m, and a length thereof in the X-axis direction is approximately 300 $\mu$m. The portion to be ejected 58G and the portion to be ejected 58B also have the same shape and size. The interval among the portions to be ejected 58R and the size of the portion to be ejected 58R correspond to an interval among pixel regions and a size of the pixel region which correspond to the same color in a high vision television of about 40-inch size.

Figure 19:
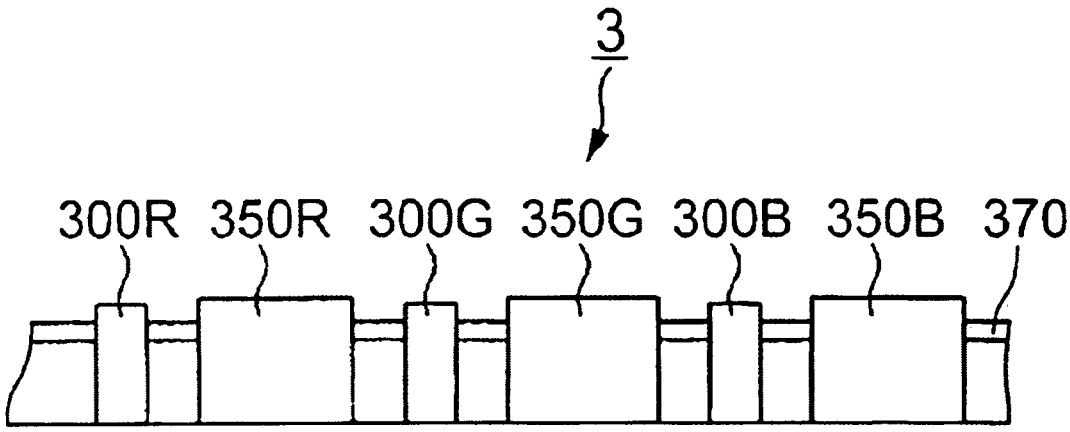
FIG. 19 is a schematic view showing a manufacturing device according the fourth embodiment.

A manufacturing device 3 shown in FIG. 19 is a device for ejecting a corresponding fluorescent material onto each of the portions to be ejected 58R, 58G and 58B of the base 50A in FIG. 18. The manufacturing device 3 comprises an ejection device 300R for coating a fluorescent material 311R to all the portions to be ejected 58R, a drying device 350R for drying the fluorescent material 311R on the portions 58R to be ejected, an ejection device 300G for coating a fluorescent material 311G to all the portions to be ejected 58G, a drying device 350G for drying the fluorescent material 311G on the portions to be ejected 58G, an ejection device 300B for coating a fluorescent material 311B to all the portions to be ejected 58B, and a drying device 350B for drying the fluorescent material 311B on the portions to be ejected 58B. In addition, the manufacturing device 3 also comprises a transferring device 370 for transferring the base 50A in an order of the ejection device 300R, the drying device 350R, the ejection device 300G, the drying device 350G, the ejection device 300B, and the drying device 350B.

Figure 20:
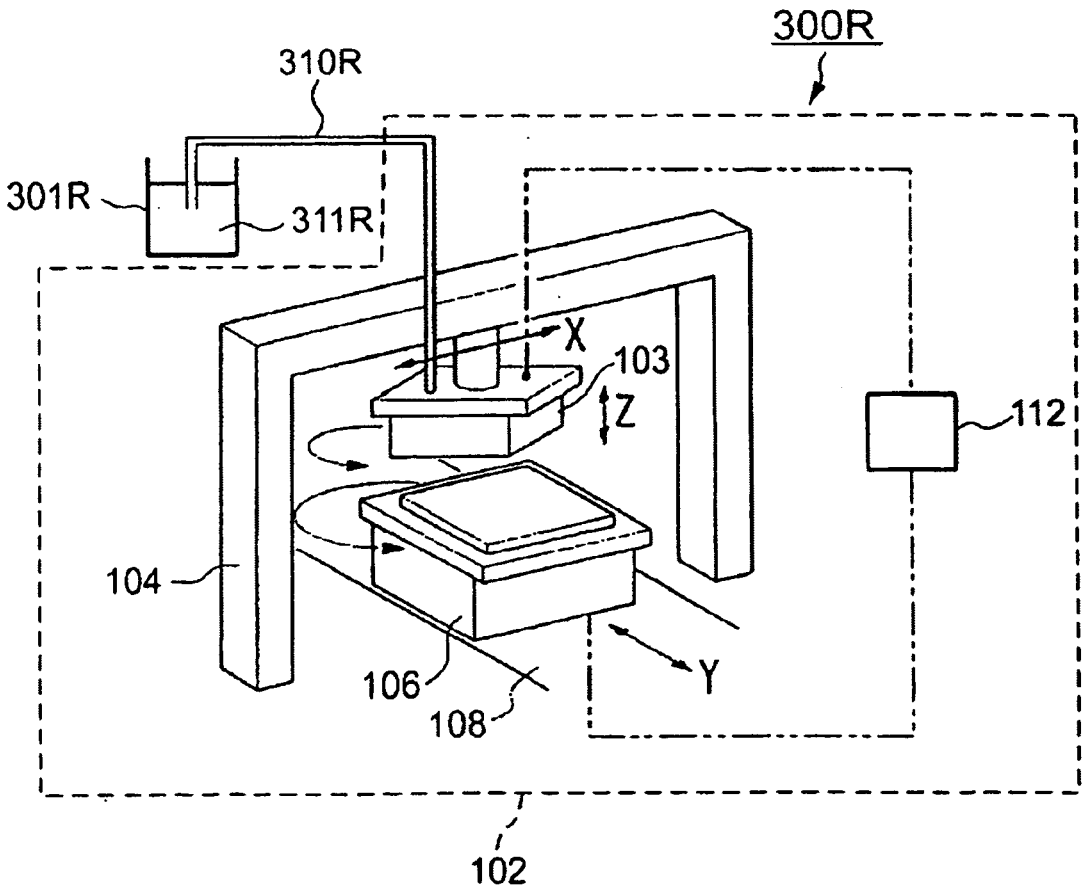
FIG. 20 is a schematic view showing an ejection device according to the fourth embodiment.

The ejection device 300R shown in FIG. 20 comprises a tank 301R for storing a liquid fluorescent material 311R, a tube 310R, and an ejection scan unit 102 to which the fluorescent material 311R is supplied from the tank 301R via the tube 310R. Since the construction of the ejection scan unit 102 is described in the first embodiment, the descriptions thereon will be omitted.

The constructions of the ejection device 300G and the ejection device 300B are basically the same as the construction of the ejection device 300R. However, the construction of the ejection device 300G is different from the construction of the ejection device 300R in that the ejection device 300G comprises a tank and a tube for a fluorescent material 311G, instead of the tank 301R and the tube 310R. Similarly, the construction of the ejection device 300B is different from the construction of the ejection device 300R in that the ejection device 300B comprises a tank and a tube for a fluorescent material 311B, instead of the tank 301R and the tube 310R. Moreover, in the present embodiment, the liquid fluorescent materials 311R, 311G and 311B is an example of liquid materials of the present invention.

A manufacturing method of a plasma display device using the manufacturing device 3 will be described. To begin with, the base 50A shown in FIG. 18 is obtained by forming the plurality of address electrodes 54, the dielectric glass layer 56 and the spacer 60 on the supporting substrate 52 using a known screen printing technique.

Next, by means of an oxygen plasma process under atmospheric pressure, the base 50A is hydrophilized. By this process, in the respective concave portions (a portion of the pixel region) defined by the spacer 60 and the dielectric glass layer 56, a surface of the spacer 60 and a surface of the dielectric glass layer 56 exhibit hydrophilic property, and these surfaces become the portions to be ejected 58R, 58G and 58B. Moreover, according to the material, the surfaces exhibiting desired hydrophilic property can be obtained, even though the above-mentioned treatment is not performed. In that case, even though the above-mentioned surface treatment is not performed, the surfaces of the concave portions defined by the spacer 60 and the dielectric glass layer 56 become the portions to be ejected 58R, 58G and 58B.

Figure 21A:
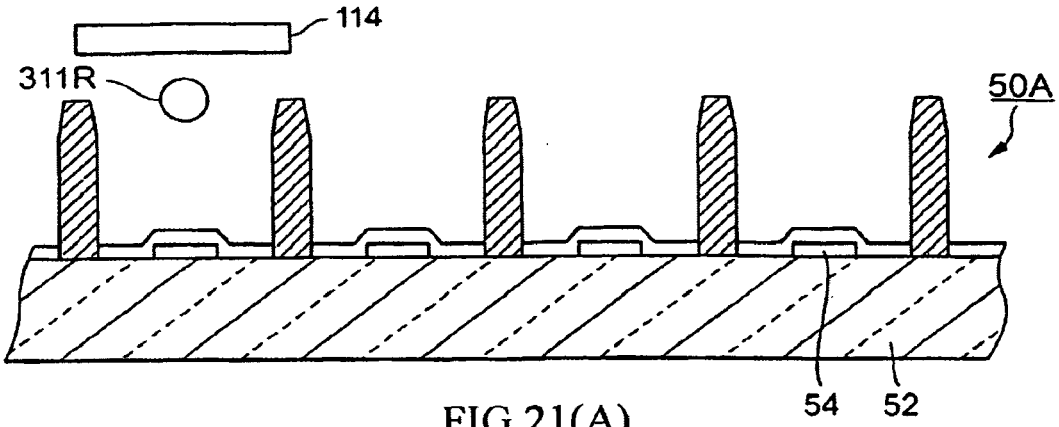
FIGS. 21(*a*)–(*c*) are schematic views showing a manufacturing method according to the fourth embodiment.
Figure 21B:
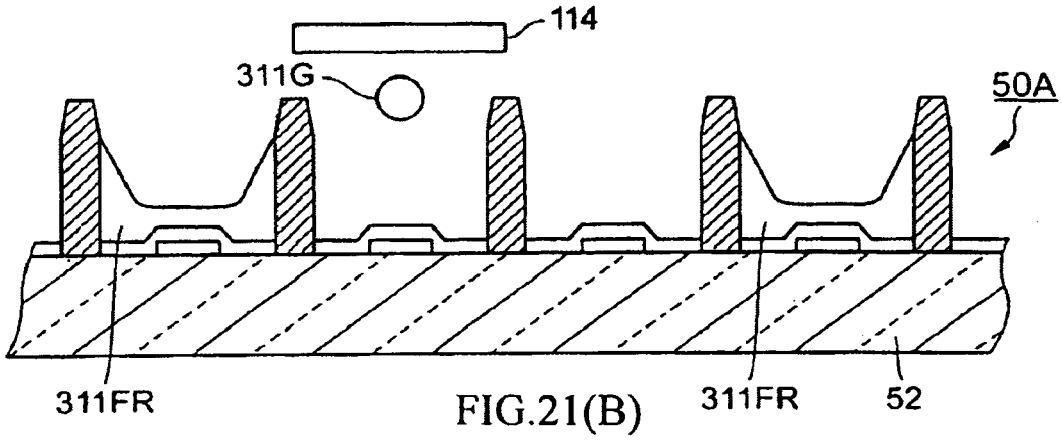
Figure 21C:
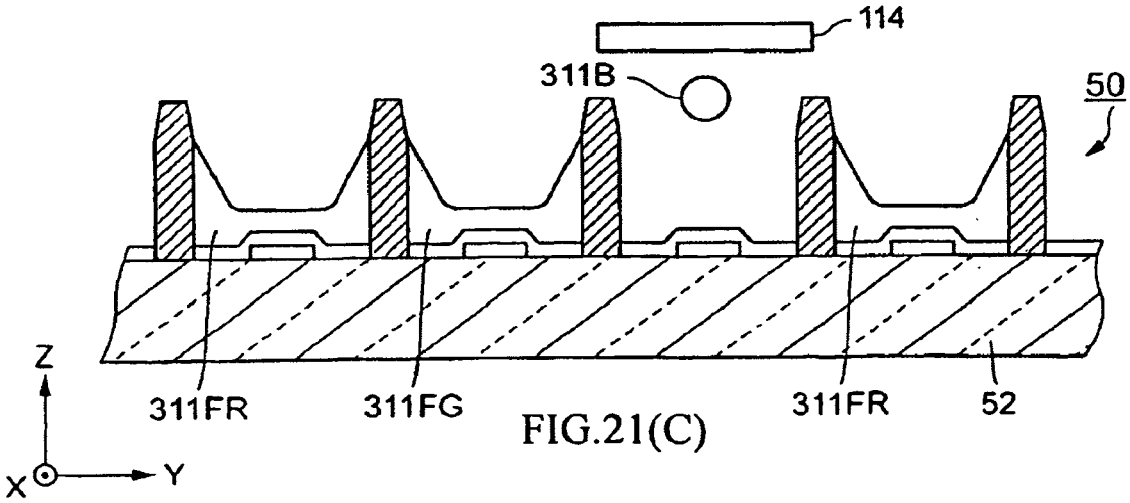

The base 50A on which the portions to be ejected 58R, 58G and 58B are formed is transferred to the stage 106 of the ejection device 300R by means of the transferring device 370. Further, as shown in FIG. 21(*a*), the ejection device 300R ejects the fluorescent material 311R from the heads 114 such that a layer of the fluorescent material 311R is formed in all the portions to be ejected 58R. More specifically, the ejection device 300R coats the fluorescent material 311R to the portions to be ejected 58R by the ejection method described with reference to FIG. 12. If the layer of the fluorescent material 311R is formed in all the portions to be ejected 58R of the base 50A, the transferring device 370 locates the base 50A in the drying device 350R. And then, the fluorescent material 311R on the portions to be ejected 58R is completely dried, such that the fluorescent layer 311FR is formed on the portions to be ejected 58R.

Next, the transferring device 370 locates the base 30A in the stage 106 of the ejection device 300G. And then, as shown in FIG. 21(*b*), the ejection device 300G ejects the fluorescent material 311G from the heads 114 such that a layer of the fluorescent material 311G is formed in all the portions to be ejected 58G. More specifically, the ejection device 300G coats the fluorescent material 311G to the portions to be ejected 58G by the ejection method described with reference to FIG. 12. If the layer of the fluorescent material 311G is formed in all the portions to be ejected 58G of the base 50A, the transferring device 370 locates the base 50A in the drying device 350G. And then, the fluorescent material 311G on the portions to be ejected 58G is completely dried, such that the fluorescent layer 311FG is formed on the portions to be ejected 58G.

Next, the transferring device 370 locates the base 50A in the stage 106 of the ejection device 300B. And then, as shown in FIG. 21(*c*), the ejection device 300B ejects the fluorescent material 311B from the heads 114 such that a layer of the fluorescent material 311B are formed in all the portions to be ejected 58B. More specifically, the ejection device 300B coats the fluorescent material 311B to the portions to be ejected 58B by the ejection method described with reference to FIG. 12. If the layer of the fluorescent material 311B is formed in all the portions to be ejected 58B of the base 50A, the transferring device 370 locates the base 50A in the drying device 350B. And then, the fluorescent material 311B on the portions to be ejected 58B is completely dried, such that the fluorescent layer 311FB is formed on the portions to be ejected 58B.

By the above processes, the base 50A becomes the rear substrate 50B of the plasma display device.

Figure 22:
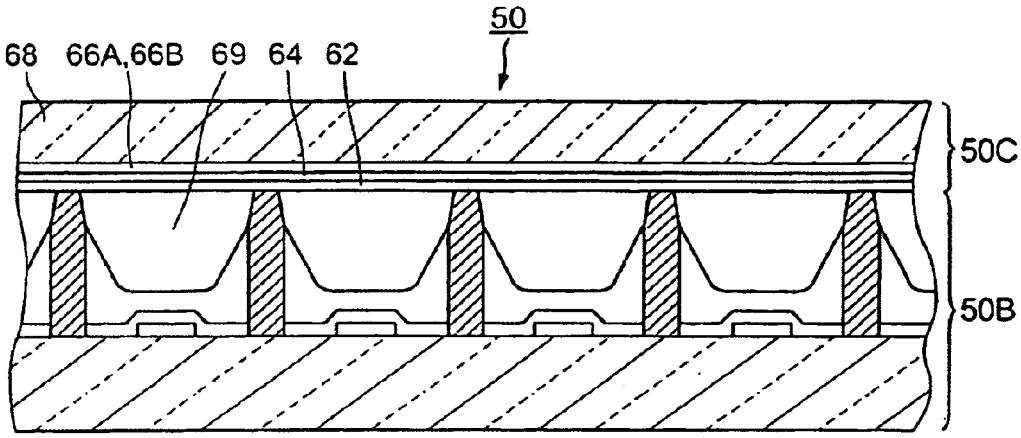
FIG. 22 is a schematic view showing a manufacturing method according to the fourth embodiment.

Next, as shown in FIG. 22, the rear substrate 50B and the front substrate 50C are bonded by a known method, to thereby obtain the plasma display device 50. The front substrate 50C comprises a glass substrate 68, display electrodes 66A and display scan electrodes 66B patterned parallel to each other, a dielectric glass layer 64 formed to cover the display electrodes 66A and the display scan electrodes 66B, and a MgO protective film 62 formed on the dielectric glass layer 64. The rear substrate 50B and the front substrate 50C are positioned such that the address electrodes 54 of the rear substrate 50B and the display electrode 66A and the display scan electrode 66B of the front substrate 50C are orthogonal to each other. In cells (pixel regions) surrounded by the spacer 60, a discharge gas 69 is filled at a predetermined pressure.

According to the present embodiment, in the respective ejection devices 300R, 300G and 300B, the nozzle pitch of the head group 114G in the X-axis direction is a length 1/N times shorter than the nozzle pitch of the head 114 in the X-axis direction. Here, N is the number of the heads 114 included in the head group 114G. For this reason, the line density of the nozzles of the ejection devices 300R, 300G and 300B in the X-axis direction is higher than the line density of the nozzles of a conventional ink jet device in the X-axis direction. Therefore, the manufacturing device 3 can coat the fluorescent material to the portions to be ejected having various sizes only by changing ejection data. In addition, the manufacturing device 3 can manufacture the plasma display device having various pitches only by changing ejection data.

Further, according to the present embodiment, the liquid droplets of the fluorescent materials 311R, 311G and 311B are ejected from the plurality of overlapping portions G onto the portions to be ejected 58R, 58G and 58B. An overall volume of the liquid droplets to be ejected from each of the overlapping portions G, that is, an overall volume of the liquid droplets to be ejected from all the nozzles 118 included in one overlapping portion G is the same. Thus, an inside of each of the portions to be ejected 58R, 58G and 58B is uniformly covered with the fluorescent material 311R, 311G and 311B. Besides, as described in the first embodiment, the nozzles 118 belonging to various sub regions SR are adjacent in the X-axis direction in the head group 114G, such that the difference in the ejected amount depending on the positions of the nozzles 118 is likely to be offset. As a result, the coat unevenness among the portions to be ejected 58R, the coat unevenness among the portions to be ejected 58G, and the coat unevenness among the portions to be ejected 58B become unnoticeable.

In addition, according to the present embodiment, the liquid droplets of the fluorescent materials 311R, 311G and 311B may hit onto a halfway between two positions already covered with the liquid droplets. Thus, a liquid droplet to be hit later contacts two liquid droplets hit in advance onto two positions which are symmetric with respect to a hit position of the liquid droplet. For this reason, on a liquid droplet to be hit later, a force of two opposing directions acts. As a result, the liquid droplet to be hit later is spread symmetrically from the hit position thereof. Thus, according to the ejection method of the present embodiment, coat unevenness of the fluorescent materials 311R, 311G and 311B is hardly generated.

Fifth Embodiment

Next, an example in which the present invention is applied to a manufacturing device of an image display device provided with an electron emission element will be described.

The base 70A shown in FIGS. 23(*a*) and 23(*b*) is a substrate which becomes an electron source substrate 70B of an image display device by means of a process with a manufacturing device 4 (FIG. 24) described below. The base 70A has a plurality of portions to be ejected 78 arranged in a matrix shape.

More specifically, the base 70A comprises a base 72, a natrium diffusion stopping layer 74 located on the base 72, a plurality of element electrode 76A and 76B disposed on the natrium diffusion stopping layer 74, a plurality of metallic wirings 79A disposed on the plurality of element electrodes 76A, and a plurality of metallic wirings 79B disposed on the plurality of element electrodes 76B. Each of the plurality of metallic wirings 79A has a shape extending in the Y-axis direction. Meanwhile, each of the plurality of metallic wirings 79B has a shape extending in the X-axis direction. Between the metallic wirings 79A and the metallic wirings 79B, an insulating film 75 is formed. Thus, the metallic wirings 79A and the metallic wirings 79B are electrically isolated from each other.

A portion including a pair of the element electrode 76A and the element electrode 76B corresponds to one pixel region.

The pair of the element electrode 76A and the element electrode 76B faces to each other by a predetermined interval on the natrium diffusion stopping layer 74. The element electrode 76A corresponding to a pixel region is electrically connected to the corresponding metallic wiring 79A. Further, the element electrode 76B corresponding to the pixel region is electrically connected to the corresponding metallic wiring 79B. Moreover, in the present specification, a unified portion of the base 72 and the natrium diffusion stopping layer 74 may be referred to as a the supporting substrate.

In the respective pixel regions of the base 70A, a portion of the element electrode 76A, a portion of the element electrode 76B and an exposed natrium diffusion stopping layer 74 between the element electrode 76A and the element electrode 76B correspond to the portion to be ejected 78. More specifically, the portion to be ejected 78 is a region in which a conductive thin film 411F (FIG. 27) is to be formed, and the conductive thin film 411F is formed to cover the portion of the element electrode 76A, the portion of the element electrode 76B and a gap between the element electrode 76A and the element electrode 76B. As indicated by a dotted line in FIG. 23(*b*), a planar shape of the portion to be ejected 78 in the present embodiment is circular. In such a manner, the planar shape of the portion to be ejected of the present invention may be circular to be determined by the X coordinate range and the Y coordinate range.

Figure 23A:
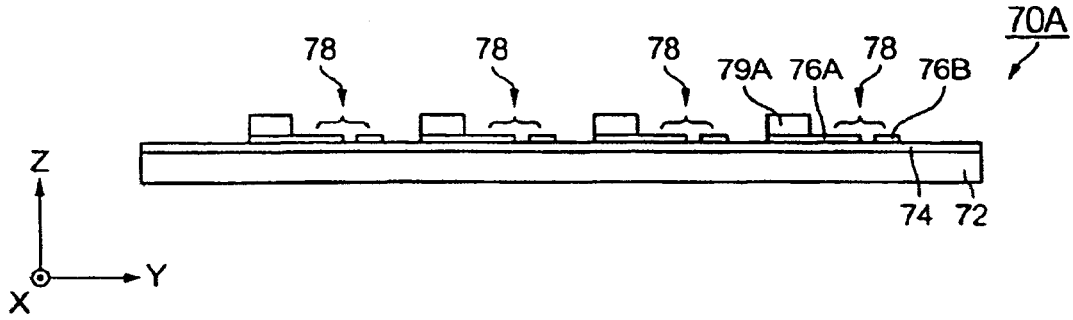
FIGS. 23(*a*) and 23(*b*) are schematic views showing a base according to a fifth embodiment.
Figure 23B:
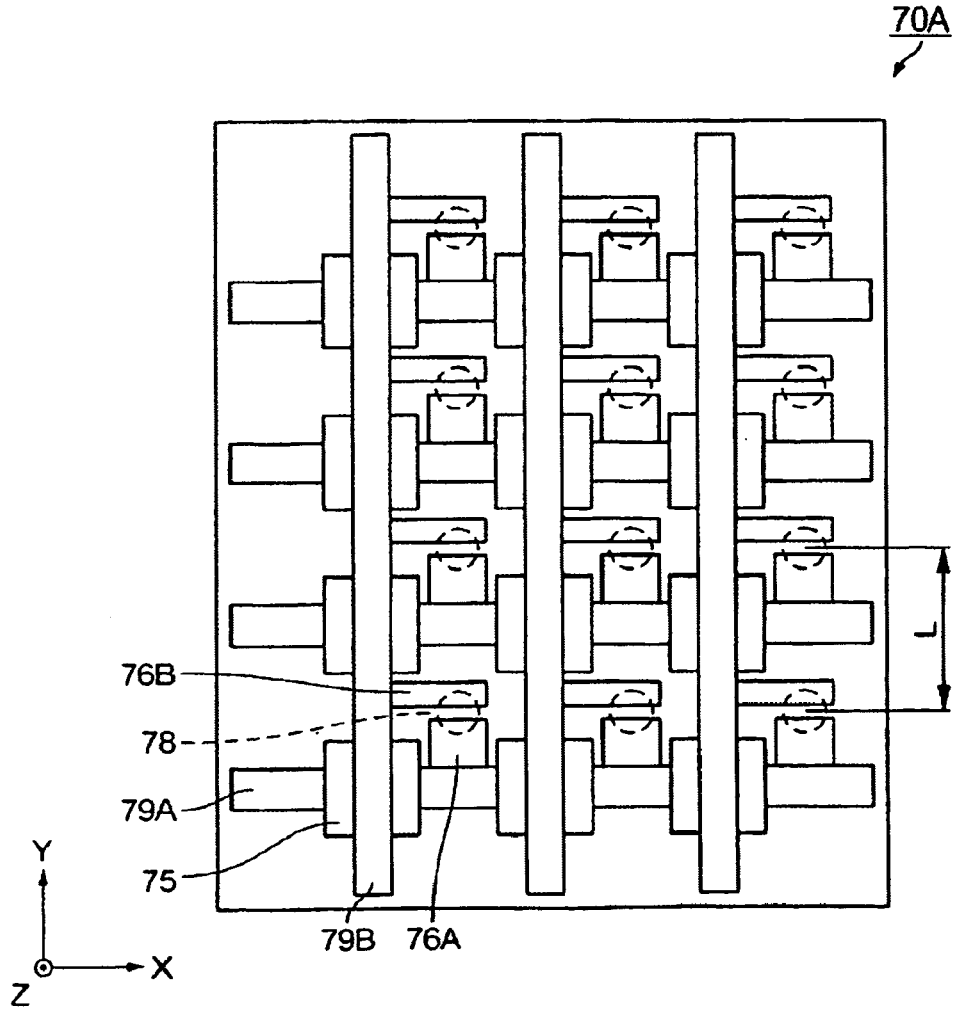

The base 70A shown in FIG. 23(*b*) is located on a virtual plane parallel to both the X-axis direction and the Y-axis direction. And then, a row direction and a column direction of a matrix to be formed by the plurality of portions to be ejected 78 are parallel to the X-axis direction and the Y-axis direction respectively. That is, in the base 70A, the plurality of portions to be ejected 78 are arranged in the X-axis direction and the Y-axis direction. Moreover, the X-axis direction and the Y-axis direction are orthogonal to each other.

A constant interval LRY along the Y-axis direction among the portions to be ejected 78, that is, a pitch, is approximately 190 $\mu$m. Further, the length of the portions to be ejected 78 in the X-axis direction (the length of the X coordinate range) is approximately 100 $\mu$m, and the length thereof in the Y-axis direction (the length of the Y coordinate range) is approximately 100 $\mu$m. The interval among the portions to be ejected 78 and the size of the portion to be ejected 78 correspond to an interval among pixel regions and a size of the pixel region in a high vision television of about 40-inch size.

Figure 24:
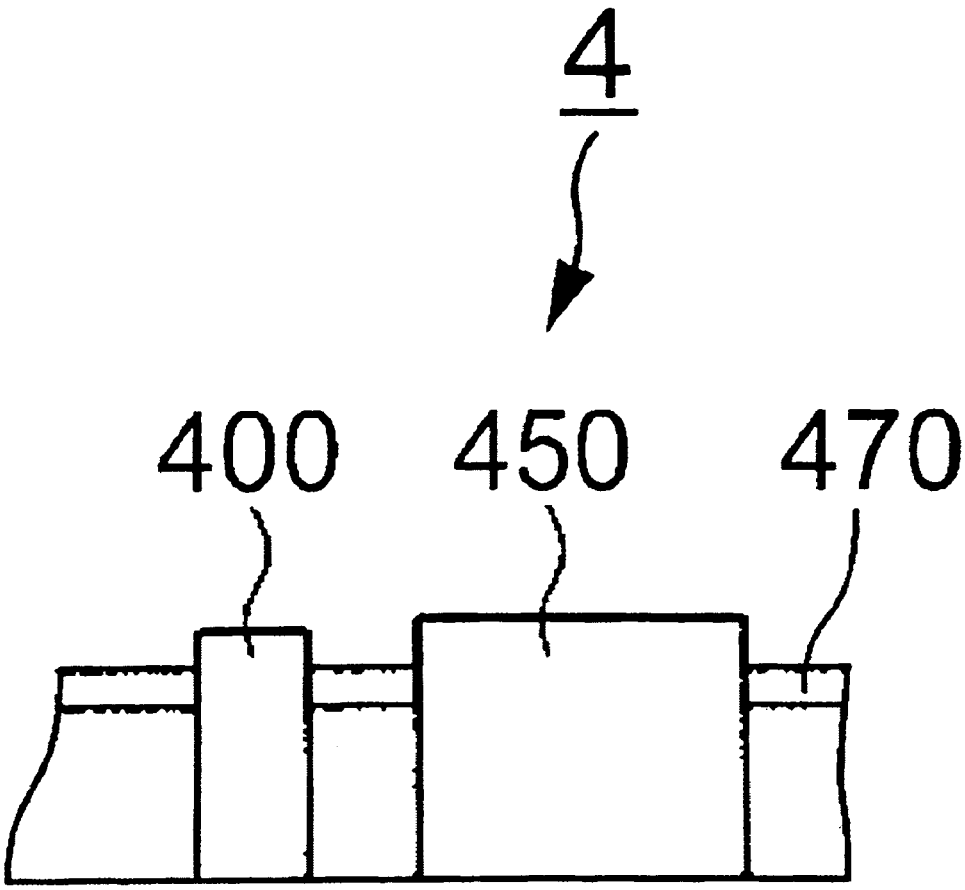
FIG. 24 is a schematic view showing a manufacturing device according the fifth embodiment.

A manufacturing device 4 shown in FIG. 24 is a device for ejecting a conductive thin film material 411 onto each of the portions to be ejected 78 of the base 70A in FIG. 23. More specifically, the manufacturing device 4 comprises an ejection device 400 for coating the conductive thin film material 411 to all the portions to be ejected 78, and a drying device 450 for drying the conductive thin film material 411 on the portions to be ejected 78. In addition, the manufacturing device 4 also comprises a transferring device 470 for transferring the base 70A in an order of the ejection device 400 and the drying device 450.

Figure 25:
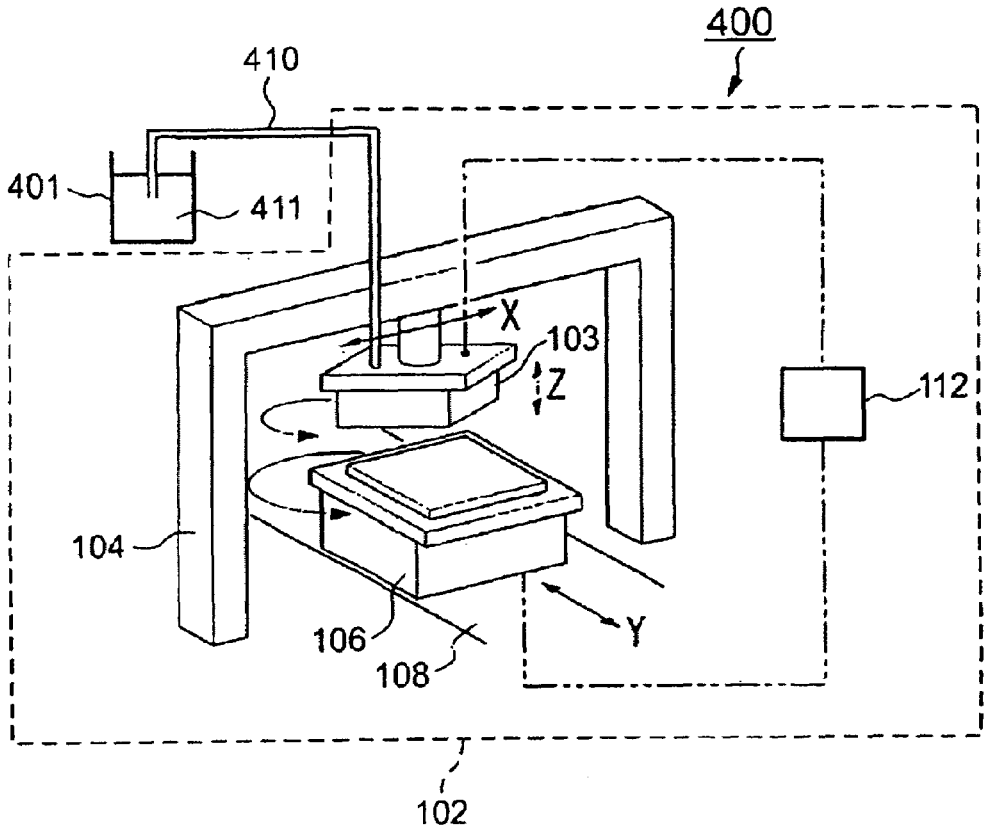
FIG. 25 is a schematic view showing an ejection device according to the fifth embodiment.

The ejection device 400 shown in FIG. 25 comprises a tank 401 for storing a liquid conductive thin film material 411, a tube 410, and an ejection scan unit 102 to which the conductive thin film material 411 is supplied from the tank 401 via the tube 410. Since the construction of the ejection scan unit 102 is described in the first embodiment, the descriptions thereon will be omitted. Moreover, in the present embodiment, the liquid conductive thin film material 411 is an organic palladium solution. Moreover, in the present embodiment, the liquid conductive thin film material 411 is an example of liquid materials of the present invention.

A manufacturing method of an image display device using the manufacturing device 4 will be described. To begin with, on the base 72 made of soda glass, the natrium diffusion stopping layer 74 made mainly of $SiO_2$ is formed. More specifically, a $SiO_2$ film of 1 $\mu$m thickness is formed on the base 72 using the sputtering method, to thereby obtain the natrium diffusion stopping layer 74. Next, on the natrium diffusion stopping layer 74, a titanium layer of 5 nm thickness is formed by the sputtering method or the vapor deposition method. And then, using the photolithography and etching techniques, a plurality of pairs of the element electrode 76A and the element electrode 76B is formed from the titanium layer, the pair of the element electrodes 76A and 76B are spaced by a predetermined distance from each other.

And then, by coating and baking Ag paste on the natrium diffusion stopping layer 74 and the plurality of element electrodes 76A using the screen printing technique, the plurality of metallic wirings 79A extending in the Y-axis direction is formed. Next, by coating and baking glass paste on a portion of each of the metallic wirings 79A using the screen printing technique, the insulating film 75 is formed. Further, by coating and baking Ag paste on the natrium diffusion stopping layer 74 and the plurality of element electrodes 76B, the plurality of metallic wirings 79B extending in the X-axis direction is formed. Moreover, in the case of forming the metallic wirings 79B, Ag paste is coated such that the metallic wirings 79B cross the metallic wirings 79A with the insulating film 75 interposed therebetween. As described above, it is possible to obtain the base 70A in FIG. 23.

Next, by means of an oxygen plasma process under atmospheric pressure, the base 70A is hydrophilized. By this process, a portion of the surface of the element electrode 76A, a portion of the surface of the element electrode 76B and a surface of the supporting substrate exposed between the element electrode 76A and the element electrode 76B are hydrophilized. These surfaces become the portion to be ejected 78. Moreover, according to the material, the surfaces exhibiting desired hydrophilic property can be obtained, even though the above-mentioned surface treatment is not performed. In that case, even though the above-mentioned surface treatment is not performed, the portion of the surface of the element electrode 76A, the portion of the surface of the element electrode 76B and a surface of the natrium diffusion stopping layer 74 exposed between the element electrode 76A and the element electrode 76B.

Figure 26:
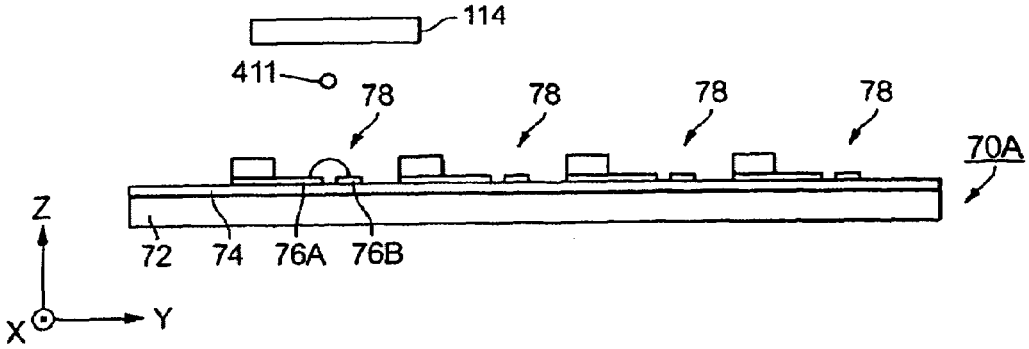
FIG. 26 is a schematic view showing a manufacturing method according to the fifth embodiment.

The base 70A on which the portions to be ejected 78 are formed is transferred to the stage 106 of the ejection device 400 by means of the transferring device 470. Further, as shown in FIG. 26, the ejection device 400 ejects the conductive thin film material 411 from the heads 114 such that a layer of the conductive thin film 411F is formed in all the portions to be ejected 78. More specifically, the ejection device 400 coats the conductive thin film material 411 to the portions to be ejected 78 by the ejection method described with reference to FIG. 12. In the present embodiment, the control unit 112 supplies a signal to the heads 114 such that a diameter of the liquid droplet of the conductive thin film material 411 hit onto the portions to be ejected 78 is in the range of 60 $\mu$m to 80 $\mu$m. If the layer of the conductive thin film material 411 is formed in all the portions to be ejected 78, the transferring device 470 locates the base 70A in the drying device 450. And then, the conductive thin film material 411 on the portions to be ejected 78 is completely dried, such that a conductive thin film 411F made mainly of palladium oxide is formed on the portions to be ejected 78. In such a manner, in the respective pixel regions, the conductive thin film 411F covering the portion of the element electrode 76A, the portion of the element electrode 76B and the exposed natrium diffusion stopping layer 74 between the element electrode 76A and the element electrode 76B.

Next, between the element electrode 76A and the element electrode 76B, a predetermined pulsed voltage is applied, such that an electron emission portion 411D is formed in the conductive thin film 411F. Moreover, it is preferable to perform the application of the voltage between the element electrode 76A and the element electrode 76B under an organic atmosphere and a vacuum condition separately. This is because, if doing so, electron emission efficiency from the electron emission portion 411D becomes higher. The element electrode 76A, the corresponding element electrode 76B, the conductive thin film 411F on which the electron emission portion 411D are the electron emission element. Further, the respective electron emission elements correspond to the pixel regions respectively.

Figure 27:
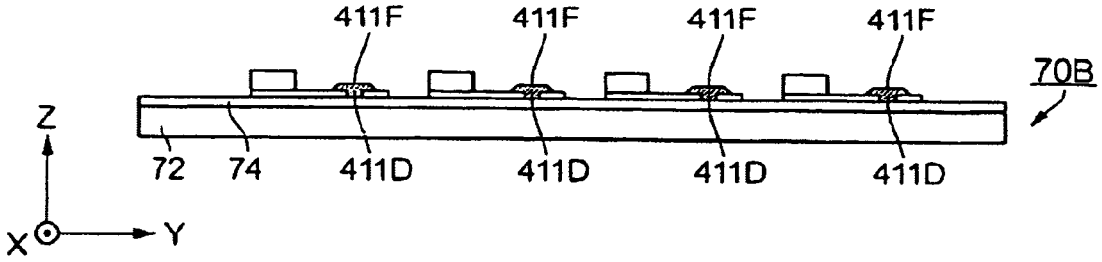
FIG. 27 is a schematic view showing a manufacturing method according to the fifth embodiment.

By means of these processes, as shown in FIG. 27, the base 70A becomes an electron source substrate 70B.

Figure 28:
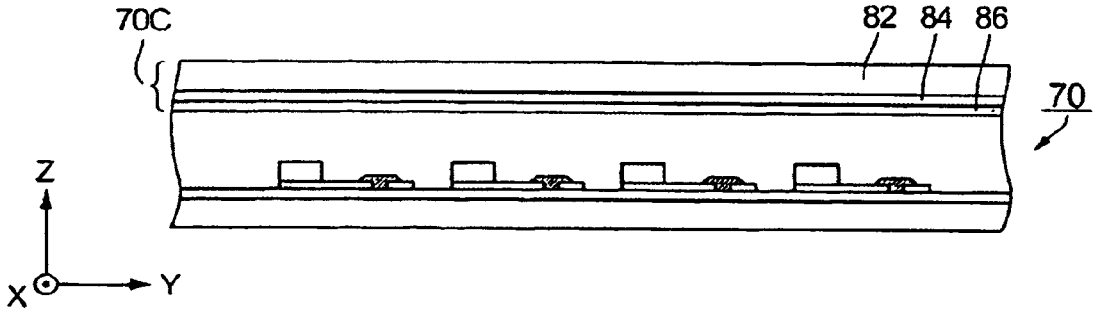
FIG. 28 is a schematic view showing a manufacturing method according to the fifth embodiment.

Next, as shown in FIG. 28, by bonding the electron source substrate 70B and the front substrate 70C with a known method, an image display device 70 is obtained. The front substrate 70C comprises a glass substrate 82, a plurality of fluorescent portions 84 disposed in a matrix shape on the glass substrate 82, and a metallic plate 86 for covering the plurality of fluorescent portions 84. The metallic plate 86 functions as an electrode for accelerating electron beams from the electron emission portions 411D. The electron source substrate 70B and the front substrate 70C are located such that each of the plurality of electron emission elements faces each of the plurality of fluorescent portions 84. Further, a space between the electron source substrate 70B and the front substrate 70C is maintained at a vacuum state.

Moreover, the image display device 70 provided with the electron emission element may be referred to as SED (Surface-Conduction Electron-Emitter Display) or FED (Field Emission Display).

According to the present embodiment, in the ejection device 400, the nozzle pitch of the head group 114G in the X-axis direction is a length 1/N time shorter than the nozzle pitch of the head 114 in the X-axis direction. Here, N is the number of the heads 114 to be included in the head group 114G. For this reason, the line density of the nozzles of the ejection device 400 in the X-axis direction is higher than the line density of the nozzles of a conventional ink jet device in the X-axis direction. Therefore, the manufacturing device 4 can coat the conductive thin film material 411 to the portions to be ejected having various sizes only by changing ejection data. In addition, the manufacturing device 4 can manufacture the electron source substrate having various pitches only by changing ejection data.

Further, according to the present embodiment, the liquid droplets of the conductive thin film material 411 are ejected from the plurality of overlapping portions G onto the portions to be ejected 78. An overall volume of the liquid droplets to be ejected from each of the overlapping portions G, that is, an overall volume of the liquid droplets to be ejected from all the nozzles 118 included in one overlapping portion G is the same. Thus, an inside of each of the portions to be ejected 78 is uniformly covered with the conductive thin film material 411. Besides, as described in the first embodiment, the nozzles 118 belonging to various sub regions SR are adjacent in the X-axis direction in the head group 114G, such that the difference in the ejected amount depending on the positions of the nozzles 118 is likely to be offset. As a result, the coat unevenness among the portions to be ejected 78 becomes unnoticeable.

In addition, according to the present embodiment, the liquid droplets of the conductive thin film material 411 may hit onto a halfway between two positions already covered with the liquid droplets. Thus, a liquid droplet to be hit later contacts two liquid droplets hit in advance onto two positions which are symmetric with respect to a hit position of the liquid droplet. For this reason, on a liquid droplet to be hit later, a force of two opposing directions acts. As a result, the liquid droplet to be hit later is spread symmetrically from the hit position thereof. Thus, according to the ejection method of the present embodiment, coat unevenness of the conductive thin film material 411 is hardly generated.

What is claimed is:

1. An ejection device comprising a stage and head groups being relatively movable with respect to the stage, wherein each head group comprises a first head, a second head, a third head, and a fourth head, each having P ejection nozzles which are arranged such that a nozzle pitch of each of the first head, the second head, the third head, and the fourth head in an X-axis direction becomes a first length, the first head and the second head are adjacent to each other in a Y-axis direction, and the third head and the fourth head are adjacent to each other in the Y-axis direction, with respect to an X coordinate shifted by a second length from an X coordinate of a reference nozzle of the first head, an X coordinate of a reference nozzle of the second head is further shifted by a length ½ times shorter than the first length, with respect to an X coordinate shifted by the second length from an X coordinate of a reference nozzle of the third head, an X coordinate of a reference nozzle of the fourth head is further shifted by a length ½ times shorter than the first length, with respect to an X coordinate shifted by the second length from the X coordinate of the reference nozzle of the second head, the X coordinate of the reference nozzle of the third head is shifted by a length ¼ times or ¾ times shorter than the first length, the second length is P/4 times shorter than the first length, P is a natural number equal to or greater than 2, and the X-axis direction is orthogonal to the Y-axis direction.

2. The ejection device according to claim 1, wherein, in each of the four heads, the P nozzles are arranged in the X-axis direction.

3. The ejection device according to claim 1, wherein in each of the four heads, the P nozzles each comprise a first string and a second string both extending in the X-axis direction, in each of the first string and the second string, the plurality of nozzles is arranged at a pitch two times longer than the first length, and the first string is shifted by the first length in the X-axis direction with respect to the second string.

4. The ejection device according to claim 1, wherein in each of the four heads, the P nozzles each comprise M strings all extending in the X-axis direction together, in each of the M strings, the P nozzles are arranged at a pitch M times longer than the first length, with respect to one of the M strings, the other (M−1) strings are shifted by a length i times longer than the first length in the X-axis direction without overlapping, M is a natural number equal to or greater than 2, and i is a natural number from 1 to (M−1).

5. The ejection device according to claim 1, wherein the stage holds a base having portions to be ejected, and when by relatively moving the head groups in the Y-axis direction with respect to the base, at least one of the P ejection nozzles are positioned at regions corresponding to the portions to be ejected, and a liquid material is ejected from the at least one ejection nozzle.

6. The ejection device according to claim 5, wherein a planar shape of each of the portions to be ejected is approximately rectangular, defined by longer sides and shorter sides, the stage holds the base such that directions of the longer sides are parallel to the X-axis direction and directions of the shorter sides are parallel to the Y-axis direction, and when by relatively moving the head groups in the Y-axis direction with respect to the base, at least two ejection nozzles of the P ejection nozzles are almost simultaneously positioned at regions corresponding to the portions to be ejected, and the liquid material is almost simultaneously ejected from the at least two ejection nozzles onto the portions to be ejected.

7. A device for manufacturing a color filter substrate, the device comprising an ejection device having a stage for holding a base and head groups being relatively movable with respect to the stage, wherein each head group comprises a first head, a second head, a third head, and a fourth head, each having P ejection nozzles capable of ejecting a liquid color filter material onto the base, the P ejection nozzles being arranged such that a nozzle pitch of each of the first head, the second head, the third head, and the fourth head becomes a first length, the first head and the second head are adjacent to each other in a Y-axis direction, and the third head and the fourth head are adjacent to each other in the Y-axis direction, with respect to an X coordinate shifted by a second length from an X coordinate of a reference nozzle of the first head, an X coordinate of a reference nozzle of the second head is further shifted by a length ½ times shorter than the first length, with respect to an X coordinate shifted by the second length from an X coordinate of a reference nozzle of the third head, an X coordinate of a reference nozzle of the fourth head is further shifted by a length ½ times shorter than the first length, with respect to an X coordinate shifted by the second length from the X coordinate of the reference nozzle of the second head, the X coordinate of the reference nozzle of the third head is shifted by a length ¼ times or ¾ times shorter than the first length, the second length is P/4 times shorter than the first length, P is a natural number equal to or greater than 2, and the X-axis direction is orthogonal to the Y-axis direction.

8. A device for manufacturing an electro-luminescent display device, the device comprising an ejection device having a stage for holding a base and head groups being relatively movable with respect to the stage, wherein each head group comprises a first head, a second head, a third head, and a fourth head, each having P ejection nozzles capable of ejecting a liquid light-emitting material to the base, the P ejection nozzles being arranged such that a nozzle pitch of each of the first head, the second head, the third head, and the fourth head becomes a first length, the first head and the second head are adjacent to each other in a Y-axis direction, and the third head and the fourth head are adjacent to each other in the Y-axis direction, with respect to an X coordinate shifted by a second length from an X coordinate of a reference nozzle of the first head, an X coordinate of a reference nozzle of the second head is further shifted by a length ½ times shorter than the first length, with respect to an X coordinate shifted by the second length from an X coordinate of a reference nozzle of the third head, an X coordinate of a reference nozzle of the fourth head is further shifted by a length ½ times shorter than the first length, with respect to an X coordinate shifted by the second length from the X coordinate of the reference nozzle of the second head, the X coordinate of the reference nozzle of the third head is shifted by a length ¼ times or ¾ times shorter than the first length, the second length is P/4 times shorter than the first length, P is a natural number equal to or greater than 2, and the X-axis direction is orthogonal to the Y-axis direction.

9. A device for manufacturing a plasma display device, the device comprising an ejection device having a stage for holding a base and head groups being relatively movable with respect to the stage, wherein each head group comprises a first head, a second head, a third head, and a fourth head, each having P ejection nozzles capable of ejecting a fluorescent material, the P ejection nozzles being arranged such that a nozzle pitch of each of the first head, the second head, the third head, and the fourth head becomes a first length, the first head and the second head are adjacent to each other in a Y-axis direction, and the third head and the fourth head are adjacent to each other in the Y-axis direction, with respect to an X coordinate shifted by a second length from an X coordinate of a reference nozzle of the first head, an X coordinate of a reference nozzle of the second head is further shifted by a length ½ times shorter than the first length, with respect to an X coordinate shifted by the second length from an X coordinate of a reference nozzle of the third head, an X coordinate of a reference nozzle of the fourth head is further shifted by a length ½ times shorter than the first length, with respect to an X coordinate shifted by the second length from the X coordinate of the reference nozzle of the second head, the X coordinate of the reference nozzle of the third head is shifted by a length ¼ times or ¾ times shorter than the first length, the second length is P/4 times shorter than the first length, P is a natural number equal to or greater than 2, and the X-axis direction is orthogonal to the Y-axis direction.

10. An ejection method comprising:

a step (a) of loading a base having portions to be ejected on a stage, and a step (b) of relatively moving a first head, a second head, a third head, and a fourth head in a Y-axis direction with respect to the base, each head being provided with P ejection nozzles arranged such that a nozzle pitch of each of the heads in an X direction becomes a first length, wherein the step (b) comprises a step (b1) of relatively moving the first head, the second head, the third head, and the fourth head in the Y-axis direction with respect to the base, while simultaneously shifting an X coordinate of a reference nozzle of the second head by a length ½ times shorter than the first length with respect to an X coordinate shifted by a second length from an X coordinate of a reference nozzle of the first head, shifting an X coordinate of a reference nozzle of the fourth head by a length ½ times shorter than the first length with respect to an X coordinate shifted by the second length from an X coordinate of a reference nozzle of the third head, and shifting the X coordinate of the reference nozzle of the third head by a length ¼ times or ¾ times shorter than the first length with respect to an X coordinate shifted by the second length from the X coordinate of the reference nozzle of the second head, the step (b1) comprises a step of continuously moving the first head or the second head relative to each other and continuously moving the third head or the fourth head relative to each other, P is a natural number equal to or greater than 2, and the second length is P/4 times shorter than the first length.

11. The ejection method according to claim 10, wherein the step (b) further comprises a step (b2) of relatively moving the four heads in the Y-axis direction with respect to the base, each head having the P ejection nozzles arranged in the X-axis direction.

12. The ejection method according to claim 10, further comprising: in the case in which at least one of the P ejection nozzles is positioned at regions corresponding to the portions to be ejected by means of the step (b), a step (c) of ejecting a liquid material from the at least one ejection nozzle onto the portions to be ejected.

13. The ejection method according to claim 12, wherein a planar shape of each of the portions to be ejected is approximately rectangular, defined by longer sides and shorter sides, the step (a) comprises a step (a1) of loading the base such that directions of the longer sides of the respective portions to be ejected are parallel to the X-axis direction and directions of the shorter sides of the respective portions to be ejected are parallel to the Y-axis direction, and the step (c) comprises a step (c1) of, in the case in which the head groups move in the Y-axis direction with respect to the base, moving almost simultaneously at least two ejection nozzles of the P ejection nozzles to regions corresponding to the portions to be ejected and almost simultaneously ejecting a liquid material from the at least two ejection nozzles onto the portions to be ejected.

* * * * *